US011084047B2

(12) United States Patent
Cacka et al.

(10) Patent No.: US 11,084,047 B2
(45) Date of Patent: Aug. 10, 2021

(54) SHOWERHEAD WITH DUAL OSCILLATING MASSAGE

(71) Applicant: Water Pik, Inc., Fort Collins, CO (US)

(72) Inventors: Joseph W. Cacka, Berthoud, CO (US); Craig P. Rogers, Fort Collins, CO (US)

(73) Assignee: WATER PIK, INC., Fort Collins, CO (US)

( * ) Notice: Subject to any disclaimer, the term of this patent is extended or adjusted under 35 U.S.C. 154(b) by 154 days.

(21) Appl. No.: 16/355,952

(22) Filed: Mar. 18, 2019

(65) Prior Publication Data

US 2019/0210045 A1 Jul. 11, 2019

Related U.S. Application Data

(62) Division of application No. 15/483,742, filed on Apr. 10, 2017, now Pat. No. 10,265,710.

(60) Provisional application No. 62/323,219, filed on Apr. 15, 2016, provisional application No. 62/423,650, filed on Nov. 17, 2016.

(51) Int. Cl.

| | |
|---|---|
| ***B05B 1/16*** | (2006.01) |
| ***B05B 1/18*** | (2006.01) |
| ***B05B 3/04*** | (2006.01) |

(52) U.S. Cl.

CPC ..... *B05B 1/169* (2013.01); *B05B 1/1636* (2013.01); *B05B 1/185* (2013.01); *B05B 3/04* (2013.01)

(58) Field of Classification Search

CPC ..... B05B 1/1636; B05B 1/169; B05B 1/18; B05B 1/185; B05B 3/04; E03C 1/0405; E03C 1/0409

See application file for complete search history.

(56) References Cited

U.S. PATENT DOCUMENTS

| | | | |
|---|---|---|---|
| 203,094 | A | 4/1878 | Wakeman |
| 204,333 | A | 5/1878 | Josias |
| 309,349 | A | 12/1884 | Hart |
| 428,023 | A | 5/1890 | Schoff |
| 432,712 | A | 7/1890 | Taylor |

(Continued)

FOREIGN PATENT DOCUMENTS

| | | |
|---|---|---|
| CA | 659510 | 3/1963 |
| CA | 2341041 | 8/1999 |

(Continued)

OTHER PUBLICATIONS

Author Unknown, "Flipside: The Bold Look of Kohler," 1 page, at least as early as Jun. 2011.

(Continued)

*Primary Examiner* — Alex M Valvis
(74) *Attorney, Agent, or Firm* — Dorsey & Whitney LLP

(57) ABSTRACT

In one embodiment, a massage mode assembly for a showerhead is disclosed. The massage mode assembly includes a drive element, a cam, and a shutter. The drive element has a drive element length or diameter, depending on the shape of the drive element, and is rotatable about an axis by fluid flowing through the showerhead. The cam is connected to the drive element and rotates with the drive element. The shutter is operably engaged with the cam and has a shutter length that is longer than the drive element length and the rotation of the cam causes the shutter to move correspondingly.

17 Claims, 23 Drawing Sheets

(56) References Cited

U.S. PATENT DOCUMENTS 445,250 A 1/1891 Lawless
453,109 A 5/1891 Dreisorner
486,986 A 11/1892 Schinke
566,384 A 8/1896 Engelhart
566,410 A 8/1896 Schinke
570,405 A 10/1896 Jerguson et al.
694,888 A 3/1902 Pfluger
800,802 A 10/1905 Franquist
832,523 A 10/1906 Andersson
835,678 A 11/1906 Hammond
845,540 A 2/1907 Ferguson
854,094 A 5/1907 Klein
926,929 A 7/1909 Dusseau
1,001,842 A 8/1911 Greenfield
1,003,037 A 9/1911 Crowe
1,018,143 A 2/1912 Vissering
1,046,573 A 12/1912 Ellis
1,130,520 A 3/1915 Kenney
1,203,466 A 10/1916 Benson
1,217,254 A 2/1917 Winslow
1,218,895 A 3/1917 Porter
1,255,577 A 2/1918 Berry
1,260,181 A 3/1918 Garnero
1,276,117 A 8/1918 Riebe
1,284,099 A 11/1918 Harris
1,327,428 A 1/1920 Gregory
1,451,800 A 4/1923 Agner
1,459,582 A 6/1923 Dubee
1,469,528 A 10/1923 Owens
1,500,921 A 7/1924 Bramson et al.
1,560,789 A 11/1925 Johnson et al.
1,597,477 A 8/1926 Panhorst
1,633,531 A 6/1927 Keller
1,669,949 A 5/1928 Reynolds
1,692,394 A 11/1928 Sundh
1,695,263 A 12/1928 Jacques
1,724,147 A 8/1929 Russell
1,724,161 A 8/1929 Wuesthoff
1,736,160 A 11/1929 Jonsson
1,754,127 A 4/1930 Srulowitz
1,758,115 A 5/1930 Kelly
1,778,658 A 10/1930 Baker
1,821,274 A 9/1931 Plummer
1,849,517 A 3/1932 Fraser
1,890,156 A 12/1932 Konig
1,906,575 A 5/1933 Goeriz
1,934,553 A 11/1933 Mueller et al.
1,946,207 A 2/1934 Haire
2,011,446 A 8/1935 Judell
2,024,930 A 12/1935 Judell
2,033,467 A 3/1936 Groeniger
2,044,445 A 6/1936 Price et al.
2,085,854 A 7/1937 Hathaway et al.
2,096,912 A 10/1937 Morris
2,117,152 A 5/1938 Crosti
D113,439 S 2/1939 Reinecke
2,196,783 A 4/1940 Shook
2,197,667 A 4/1940 Shook
2,216,149 A 10/1940 Weiss
D126,433 S 4/1941 Enthof
2,251,192 A 7/1941 Krumsiek et al.
2,268,263 A 12/1941 Newell et al.
2,285,831 A 6/1942 Pennypacker
2,342,757 A 2/1944 Roser
2,402,741 A 6/1946 Draviner
D147,258 S 8/1947 Becker
D152,584 S 2/1949 Becker
2,467,954 A 4/1949 Becker
2,518,709 A 8/1950 Mosby, Jr.
2,546,348 A 3/1951 Schuman
2,567,642 A 9/1951 Penshaw
2,581,129 A 1/1952 Muldoon
D166,073 S 3/1952 Dunkelberger
2,648,762 A 8/1953 Dunkelberger
2,664,271 A 12/1953 Arutunoff
2,671,693 A 3/1954 Hyser et al.
2,676,806 A 4/1954 Bachman
2,679,575 A 5/1954 Haberstump
2,680,358 A 6/1954 Zublin
2,726,120 A 12/1955 Bletcher et al.
2,759,765 A 8/1956 Pawley
2,776,168 A 1/1957 Schweda
2,792,847 A 5/1957 Spencer
2,873,999 A 2/1959 Webb
2,930,505 A 3/1960 Meyer
2,931,672 A 4/1960 Merritt et al.
2,935,265 A 5/1960 Richter
2,949,242 A 8/1960 Blumberg et al.
2,957,587 A 10/1960 Tobin
2,966,311 A 12/1960 Davis
D190,295 S 5/1961 Becker
2,992,437 A 7/1961 Nelson et al.
3,007,648 A 11/1961 Fraser
D192,935 S 5/1962 Becker
3,032,357 A 5/1962 Shames et al.
3,034,809 A 5/1962 Greenberg
3,037,799 A 6/1962 Mulac
3,081,339 A 3/1963 Green et al.
3,092,333 A 6/1963 Gaiotto
3,098,508 A 7/1963 Gerdes
3,103,723 A 9/1963 Becker
3,104,815 A 9/1963 Schultz
3,104,827 A 9/1963 Aghnides
3,111,277 A 11/1963 Grimsley
3,112,073 A 11/1963 Larson et al.
3,143,857 A 8/1964 Eaton
3,196,463 A 7/1965 Farneth
3,231,200 A 1/1966 Heald
3,236,545 A 2/1966 Parkes et al.
3,239,152 A 3/1966 Bachli et al.
3,266,059 A 8/1966 Stelle
3,272,437 A 9/1966 Coson
3,273,359 A 9/1966 Fregeolle
3,306,634 A 2/1967 Groves et al.
3,323,148 A 6/1967 Burnon
3,329,967 A 7/1967 Martinez et al.
3,341,132 A 9/1967 Parkison
3,342,419 A 9/1967 Weese
3,344,994 A 10/1967 Fife
3,363,842 A 1/1968 Burns
3,383,051 A 5/1968 Fiorentino
3,389,925 A 6/1968 Gottschald
3,393,311 A 7/1968 Dahl
3,393,312 A 7/1968 Dahl
3,404,410 A 10/1968 Sumida
3,492,029 A 1/1970 French et al.
3,516,611 A 6/1970 Piggott
3,546,961 A 12/1970 Marton
3,550,863 A 12/1970 McDermott
3,552,436 A 1/1971 Stewart
3,565,116 A 2/1971 Gabin
3,566,917 A 3/1971 White
3,580,513 A 5/1971 Martin
3,584,822 A 6/1971 Oram
3,596,835 A 8/1971 Smith et al.
3,612,577 A 10/1971 Pope
3,637,143 A 1/1972 Shames et al.
3,641,333 A 2/1972 Gendron
3,647,144 A 3/1972 Parkison et al.
3,663,044 A 5/1972 Contreras et al.
3,669,470 A 6/1972 Deurloo
3,672,648 A 6/1972 Price
3,682,392 A 8/1972 Kint
3,685,745 A 8/1972 Peschcke-koedt
D224,834 S 9/1972 Laudell
3,711,029 A 1/1973 Bartlett
3,722,798 A 3/1973 Bletcher et al.
3,722,799 A 3/1973 Rauh
3,731,084 A 5/1973 Trevorrow
3,754,779 A 8/1973 Peress
D228,622 S 10/1973 Juhlin
3,762,648 A 10/1973 Deines et al.
3,768,735 A 10/1973 Ward
3,786,995 A 1/1974 Manoogian et al.

(56) References Cited

U.S. PATENT DOCUMENTS 3,801,019 A 4/1974 Trenary et al.
3,810,580 A 5/1974 Rauh
3,826,454 A 7/1974 Zieger
3,840,734 A 10/1974 Oram
3,845,291 A 10/1974 Portyrata
3,860,271 A 1/1975 Rodgers
3,861,719 A 1/1975 Hand
3,865,310 A 2/1975 Elkins et al.
3,869,151 A 3/1975 Fletcher et al.
3,887,136 A 6/1975 Anderson
3,896,845 A 7/1975 Parker
3,902,671 A 9/1975 Symmons
3,910,277 A 10/1975 Zimmer
D237,708 S 11/1975 Grohe
3,929,164 A 12/1975 Richter
3,929,287 A 12/1975 Givler et al.
3,958,756 A 5/1976 Trenary et al.
D240,322 S 6/1976 Staub
3,963,179 A 6/1976 Tomaro
3,967,783 A 7/1976 Halsted et al.
3,979,096 A 9/1976 Zieger
3,994,443 A 11/1976 Shenker
3,997,116 A 12/1976 Moen
3,998,390 A 12/1976 Peterson et al.
3,999,714 A 12/1976 Lang
4,005,880 A 2/1977 Anderson et al.
4,006,920 A 2/1977 Sadler et al.
4,023,782 A 5/1977 Eifer
4,042,984 A 8/1977 Butler
4,045,054 A 8/1977 Arnold
D245,858 S 9/1977 Grube
D245,860 S 9/1977 Grube
4,068,801 A 1/1978 Leutheuser
4,081,135 A 3/1978 Tomaro
4,084,271 A 4/1978 Ginsberg
4,091,998 A 5/1978 Peterson
D249,356 S 9/1978 Nagy
4,117,979 A 10/1978 Lagarelli et al.
4,129,257 A 12/1978 Eggert
4,130,120 A 12/1978 Kohler, Jr.
4,131,233 A 12/1978 Koenig
4,133,486 A 1/1979 Fanella
4,135,549 A 1/1979 Baker
D251,045 S 2/1979 Grube
4,141,502 A 2/1979 Grohe
4,151,955 A 5/1979 Stouffer
4,151,957 A 5/1979 Gecewicz et al.
4,162,801 A 7/1979 Kresky et al.
4,165,837 A 8/1979 Rundzaitis
4,167,196 A 9/1979 Morris
4,174,822 A 11/1979 Larsson
4,185,781 A 1/1980 O'Brien
4,190,207 A 2/1980 Fienhold et al.
4,191,332 A 3/1980 De Langis et al.
4,203,550 A 5/1980 On
4,209,132 A 6/1980 Kwan
D255,626 S 7/1980 Grube
4,219,160 A 8/1980 Allred, Jr.
4,221,338 A 9/1980 Shames et al.
4,239,409 A 12/1980 Osrwo
4,243,253 A 1/1981 Rogers, Jr.
4,244,526 A 1/1981 Arth
D258,677 S 3/1981 Larsson
4,254,914 A 3/1981 Shames et al.
4,258,414 A 3/1981 Sokol
4,272,022 A 6/1981 Evans
4,274,400 A 6/1981 Baus
4,275,843 A 6/1981 Moen
4,282,612 A 8/1981 King
D261,300 S 10/1981 Klose
D261,417 S 10/1981 Klose
4,303,201 A * 12/1981 Elkins ..... B05B 1/1636
239/381
4,319,608 A 3/1982 Raikov et al.
4,324,364 A 4/1982 Buzzi et al.
4,330,089 A 5/1982 Finkbeiner
D266,212 S 9/1982 Haug et al.
4,350,298 A 9/1982 Tada
4,353,508 A 10/1982 Butterfield et al.
4,358,056 A 11/1982 Greenhut et al.
D267,582 S 1/1983 MacKay et al.
D268,359 S 3/1983 Klose
D268,442 S 3/1983 Darmon
D268,611 S 4/1983 Klose
4,383,554 A 5/1983 Merriman
4,396,797 A 8/1983 Sakuragi et al.
4,398,669 A 8/1983 Fienhold
4,425,965 A 1/1984 Bayh, III et al.
4,432,392 A 2/1984 Paley
D274,457 S 6/1984 Haug
4,461,052 A 7/1984 Mostul
4,465,308 A 8/1984 Martini
4,467,964 A 8/1984 Kaeser
4,495,550 A 1/1985 Visciano
4,527,745 A 7/1985 Butterfield et al.
4,540,202 A 9/1985 Amphoux et al.
4,545,081 A 10/1985 Nestor et al.
4,553,775 A 11/1985 Hailing
D281,820 S 12/1985 Oba et al.
4,561,593 A 12/1985 Cammack et al.
4,564,889 A 1/1986 Bolson
4,571,003 A 2/1986 Roling et al.
4,572,232 A 2/1986 Gruber
D283,645 S 4/1986 Tanaka
4,587,991 A 5/1986 Chorkey
4,588,130 A 5/1986 Trenary et al.
4,598,866 A 7/1986 Cammack et al.
4,614,303 A 9/1986 Moseley, Jr. et al.
4,616,298 A 10/1986 Bolson
4,618,100 A 10/1986 White et al.
4,629,124 A 12/1986 Gruber
4,629,125 A 12/1986 Liu
4,643,463 A 2/1987 Halling et al.
4,645,244 A 2/1987 Curtis
RE32,386 E 3/1987 Hunter
4,650,120 A 3/1987 Kress
4,650,470 A 3/1987 Epstein
4,652,025 A 3/1987 Conroy, Sr.
4,654,900 A 4/1987 McGhee
4,657,185 A 4/1987 Rundzaitis
4,669,666 A 6/1987 Finkbeiner
4,669,757 A 6/1987 Bartholomew
4,674,687 A 6/1987 Smith et al.
4,683,917 A 8/1987 Bartholomew
4,703,893 A 11/1987 Gruber
4,717,180 A 1/1988 Roman
4,719,654 A 1/1988 Blessing
4,733,337 A 3/1988 Bieberstein
D295,437 S 4/1988 Fabian
4,739,801 A 4/1988 Kimura et al.
4,749,126 A 6/1988 Kessener et al.
D296,582 S 7/1988 Haug et al.
4,754,928 A 7/1988 Rogers et al.
D297,160 S 8/1988 Robbins
4,764,047 A 8/1988 Johnston et al.
4,778,104 A 10/1988 Fisher
4,778,111 A 10/1988 Leap
4,787,591 A 11/1988 Villacorta
4,790,294 A 12/1988 Allred, III et al.
4,801,091 A 1/1989 Sandvik
4,809,369 A 3/1989 Bowden
4,839,599 A 6/1989 Fischer
4,841,590 A 6/1989 Terry
4,842,059 A 6/1989 Tomek
D302,325 S 7/1989 Charet et al.
4,850,616 A 7/1989 Pava
4,854,499 A 8/1989 Neuman
4,856,822 A 8/1989 Parker
4,865,362 A 9/1989 Holden
D303,830 S 10/1989 Ramsey et al.
4,871,196 A 10/1989 Kingsford
4,896,658 A 1/1990 Yonekubo et al.
D306,351 S 2/1990 Charet et al.
4,901,927 A 2/1990 Valdivia

(56) References Cited

U.S. PATENT DOCUMENTS 4,903,178 A 2/1990 Englot et al.
4,903,897 A 2/1990 Hayes
4,903,922 A 2/1990 Harris, III
4,907,137 A 3/1990 Schladitz et al.
4,907,744 A 3/1990 Jousson
4,909,435 A 3/1990 Kidouchi et al.
4,914,759 A 4/1990 Goff
4,946,202 A 8/1990 Perricone
4,951,329 A 8/1990 Shaw
4,953,585 A 9/1990 Rollini et al.
4,964,573 A 10/1990 Lipski
4,972,048 A 11/1990 Martin
D313,267 S 12/1990 Lenci et al.
4,976,460 A 12/1990 Newcombe et al.
D314,246 S 1/1991 Bache
D315,191 S 3/1991 Mikol
4,998,673 A 3/1991 Pilolla
5,004,158 A 4/1991 Halem et al.
D317,348 S 6/1991 Geneve et al.
5,020,570 A 6/1991 Cotter
5,022,103 A 6/1991 Faist
D317,968 S 7/1991 Tsai
5,032,015 A 7/1991 Christianson
5,033,528 A 7/1991 Volcani
5,033,897 A 7/1991 Chen
D319,294 S 8/1991 Kohler, Jr. et al.
D320,064 S 9/1991 Presman
5,046,764 A 9/1991 Kimura et al.
D321,062 S 10/1991 Bonbright
5,058,804 A 10/1991 Yonekubo et al.
D322,119 S 12/1991 Haug et al.
D322,681 S 12/1991 Yuen
5,070,552 A 12/1991 Gentry et al.
D323,545 S 1/1992 Ward
5,082,019 A 1/1992 Tetrault
5,086,878 A 2/1992 Swift
5,090,624 A 2/1992 Rogers
5,100,055 A 3/1992 Rokitenetz et al.
D325,769 S 4/1992 Haug et al.
D325,770 S 4/1992 Haug et al.
5,103,384 A 4/1992 Drohan
D326,311 S 5/1992 Lenci et al.
D327,115 S 6/1992 Rogers
5,121,511 A 6/1992 Sakamoto et al.
D327,729 S 7/1992 Rogers
5,127,580 A 7/1992 Fu-I
5,134,251 A 7/1992 Martin
D328,944 S 8/1992 Robbins
5,141,016 A 8/1992 Nowicki
D329,504 S 9/1992 Yuen
5,143,300 A 9/1992 Cutler
5,145,114 A 9/1992 Monch
5,148,556 A 9/1992 Bottoms et al.
D330,068 S 10/1992 Haug et al.
D330,408 S 10/1992 Thacker
D330,409 S 10/1992 Raffo
5,153,976 A 10/1992 Benchaar et al.
5,154,355 A 10/1992 Gonzalez
5,154,483 A 10/1992 Zeller
5,161,567 A 11/1992 Humpert
5,163,752 A 11/1992 Copeland et al.
5,171,429 A 12/1992 Yasuo
5,172,860 A 12/1992 Yuch
5,172,862 A 12/1992 Heimann et al.
5,172,866 A 12/1992 Ward
D332,303 S 1/1993 Klose
D332,994 S 2/1993 Huen
D333,339 S 2/1993 Klose
5,197,767 A 3/1993 Kimura et al.
D334,794 S 4/1993 Klose
D335,171 S 4/1993 Lenci et al.
5,201,468 A 4/1993 Freier et al.
5,206,963 A 5/1993 Wiens
5,207,499 A 5/1993 Vajda et al.
5,213,267 A 5/1993 Heimann et al.
5,220,697 A 6/1993 Birchfield
D337,839 S 7/1993 Zeller
5,228,625 A 7/1993 Grassberger
5,230,106 A 7/1993 Henkin et al.
D338,542 S 8/1993 Yuen
5,232,162 A 8/1993 Chih
D339,492 S 9/1993 Klose
D339,627 S 9/1993 Klose
D339,848 S 9/1993 Gottwald
5,246,169 A 9/1993 Heimann et al.
5,246,301 A 9/1993 Hirasawa
D340,376 S 10/1993 Klose
5,253,670 A 10/1993 Perrott
5,253,807 A 10/1993 Newbegin
5,254,809 A 10/1993 Martin
D341,007 S 11/1993 Haug et al.
D341,191 S 11/1993 Klose
D341,220 S 11/1993 Eagan
5,263,646 A 11/1993 McCauley
5,265,833 A 11/1993 Heimann et al.
5,268,826 A 12/1993 Greene
5,276,596 A 1/1994 Krenzel
5,277,391 A 1/1994 Haug et al.
5,286,071 A 2/1994 Storage
5,288,110 A 2/1994 Allread
5,294,054 A 3/1994 Benedict et al.
5,297,735 A 3/1994 Heimann et al.
5,297,739 A 3/1994 Allen
D345,811 S 4/1994 Van Deursen et al.
D346,426 S 4/1994 Warshawsky
D346,428 S 4/1994 Warshawsky
D346,430 S 4/1994 Warshawsky
D347,262 S 5/1994 Black et al.
D347,265 S 5/1994 Gottwald
5,316,216 A 5/1994 Cammack et al.
D348,720 S 7/1994 Haug et al.
5,329,650 A 7/1994 Zaccai et al.
D349,947 S 8/1994 Hing-Wah
5,333,787 A 8/1994 Smith et al.
5,333,789 A 8/1994 Garneys
5,340,064 A 8/1994 Heimann et al.
5,340,165 A 8/1994 Sheppard
D350,808 S 9/1994 Warshawsky
5,344,080 A 9/1994 Matsui
5,349,987 A 9/1994 Shieh
5,356,076 A 10/1994 Bishop
5,356,077 A 10/1994 Shames
D352,092 S 11/1994 Warshawsky
D352,347 S 11/1994 Dannenberg
D352,766 S 11/1994 Hill et al.
5,368,235 A 11/1994 Drozdoff et al.
5,369,556 A 11/1994 Zeller
5,370,427 A 12/1994 Hoelle et al.
5,385,500 A 1/1995 Schmidt
D355,242 S 2/1995 Warshawsky
D355,703 S 2/1995 Duell
D356,626 S 3/1995 Wang
5,397,064 A 3/1995 Heitzman
5,398,872 A 3/1995 Joubran
5,398,977 A 3/1995 Berger et al.
5,402,812 A 4/1995 Moineau et al.
5,405,089 A 4/1995 Heimann et al.
5,414,879 A 5/1995 Hiraishi et al.
5,423,348 A 6/1995 Jezek et al.
5,433,384 A 7/1995 Chan et al.
D361,399 S 8/1995 Carbone et al.
D361,623 S 8/1995 Huen
5,441,075 A 8/1995 Clare
5,449,206 A 9/1995 Lockwood
D363,360 S 10/1995 Santarsiero
5,454,809 A 10/1995 Janssen
5,468,057 A 11/1995 Megerle et al.
D364,935 S 12/1995 deBlois
D365,625 S 12/1995 Bova
D365,646 S 12/1995 deBlois
5,476,225 A 12/1995 Chan
D366,309 S 1/1996 Huang
D366,707 S 1/1996 Kaiser
D366,708 S 1/1996 Santarsiero

(56) References Cited

U.S. PATENT DOCUMENTS

D366,709 S 1/1996 Szymanski
D366,710 S 1/1996 Szymanski
5,481,765 A 1/1996 Wang
D366,948 S 2/1996 Carbone
D367,315 S 2/1996 Andrus
D367,333 S 2/1996 Swyst
D367,696 S 3/1996 Andrus
D367,934 S 3/1996 Carbone
D368,146 S 3/1996 Carbone
D368,317 S 3/1996 Swyst
5,499,767 A 3/1996 Morand
D368,539 S 4/1996 Carbone et al.
D368,540 S 4/1996 Santarsiero
D368,541 S 4/1996 Kaiser et al.
D368,542 S 4/1996 deBlois et al.
D369,204 S 4/1996 Andrus
D369,205 S 4/1996 Andrus
5,507,436 A 4/1996 Ruttenberg
D369,873 S 5/1996 deBlois et al.
D369,874 S 5/1996 Santarsiero
D369,875 S 5/1996 Carbone
D370,052 S 5/1996 Chan et al.
D370,250 S 5/1996 Fawcett et al.
D370,277 S 5/1996 Kaiser
D370,278 S 5/1996 Nolan
D370,279 S 5/1996 deBlois
D370,280 S 5/1996 Kaiser
D370,281 S 5/1996 Johnstone et al.
5,517,392 A 5/1996 Rousso et al.
5,521,803 A 5/1996 Eckert et al.
D370,542 S 6/1996 Santarsiero
D370,735 S 6/1996 deBlois
D370,987 S 6/1996 Santarsiero
D370,988 S 6/1996 Santarsiero
D371,448 S 7/1996 Santarsiero
D371,618 S 7/1996 Nolan
D371,619 S 7/1996 Szymanski
D371,856 S 7/1996 Carbone
D372,318 S 7/1996 Szymanski
D372,319 S 7/1996 Carbone
5,531,625 A 7/1996 Zhong
5,539,624 A 7/1996 Dougherty
D372,548 S 8/1996 Carbone
D372,998 S 8/1996 Carbone
D373,210 S 8/1996 Santarsiero
5,547,132 A 8/1996 Grogran
5,547,374 A 8/1996 Coleman
D373,434 S 9/1996 Nolan
D373,435 S 9/1996 Nolan
D373,645 S 9/1996 Johnstone et al.
D373,646 S 9/1996 Szymanski et al.
D373,647 S 9/1996 Kaiser
D373,648 S 9/1996 Kaiser
D373,649 S 9/1996 Carbone
D373,651 S 9/1996 Szymanski
D373,652 S 9/1996 Kaiser
5,551,637 A 9/1996 Lo
5,552,973 A 9/1996 Hsu
5,558,278 A 9/1996 Gallorini
D374,271 S 10/1996 Fleischmann
D374,297 S 10/1996 Kaiser
D374,298 S 10/1996 Swyst
D374,299 S 10/1996 Carbone
D374,493 S 10/1996 Szymanski
D374,494 S 10/1996 Santarsiero
D374,732 S 10/1996 Kaiser
D374,733 S 10/1996 Santasiero
5,560,548 A 10/1996 Mueller et al.
5,567,115 A 10/1996 Carbone
D375,541 S 11/1996 Michaluk
5,577,664 A 11/1996 Heitzman
D376,217 S 12/1996 Kaiser
D376,860 S 12/1996 Santarsiero
D376,861 S 12/1996 Johnstone et al.
D376,862 S 12/1996 Carbone
5,605,173 A 2/1997 Arnaud
D378,401 S 3/1997 Neufeld et al.
5,613,638 A 3/1997 Blessing
5,613,639 A 3/1997 Storm et al.
5,615,837 A 4/1997 Roman
5,624,074 A 4/1997 Parisi
5,624,498 A 4/1997 Lee et al.
D379,212 S 5/1997 Chan
D379,404 S 5/1997 Spelts
5,632,049 A 5/1997 Chen
D381,405 S 7/1997 Waidele et al.
D381,737 S 7/1997 Chan
D382,936 S 8/1997 Shfaram
5,653,260 A 8/1997 Huber
5,667,146 A 9/1997 Pimentel et al.
D385,332 S 10/1997 Andrus
D385,333 S 10/1997 Caroen et al.
D385,334 S 10/1997 Caroen et al.
D385,616 S 10/1997 Dow et al.
D385,947 S 11/1997 Dow et al.
D387,230 S 12/1997 von Buelow et al.
5,697,557 A 12/1997 Blessing et al.
5,699,964 A 12/1997 Bergmann et al.
5,702,057 A 12/1997 Huber
D389,558 S 1/1998 Andrus
5,704,080 A 1/1998 Kuhne
5,707,011 A 1/1998 Bosio
5,718,380 A 2/1998 Schorn et al.
D392,369 S 3/1998 Chan
5,730,361 A 3/1998 Thonnes
5,730,362 A 3/1998 Cordes
5,730,363 A 3/1998 Kress
5,742,961 A 4/1998 Casperson et al.
D394,490 S 5/1998 Andrus et al.
5,746,375 A 5/1998 Guo
5,749,552 A 5/1998 Fan
5,749,602 A 5/1998 Delaney et al.
D394,899 S 6/1998 Caroen et al.
D395,074 S 6/1998 Neibrook et al.
D395,075 S 6/1998 Kolada
D395,142 S 6/1998 Neibrook
5,764,760 A 6/1998 Grandbert et al.
5,765,760 A 6/1998 Kuo
5,769,802 A 6/1998 Wang
5,772,120 A 6/1998 Huber
5,778,939 A 7/1998 Hok-Yin
5,788,157 A 8/1998 Kress
D398,370 S 9/1998 Purdy
5,806,771 A 9/1998 Loschelder et al.
5,819,791 A 10/1998 Chronister et al.
5,820,574 A 10/1998 Henkin et al.
5,823,431 A 10/1998 Pierce
5,823,442 A 10/1998 Guo
5,826,803 A 10/1998 Cooper
5,833,138 A 11/1998 Crane et al.
5,839,666 A 11/1998 Heimann et al.
D402,350 S 12/1998 Andrus
D403,754 S 1/1999 Gottwald
D404,116 S 1/1999 Bosio
5,855,348 A 1/1999 Fornara
5,860,599 A 1/1999 Lin
5,862,543 A 1/1999 Reynoso et al.
5,862,985 A 1/1999 Neibrook et al.
D405,502 S 2/1999 Tse
5,865,375 A 2/1999 Hsu
5,865,378 A 2/1999 Hollinshead et al.
5,873,647 A 2/1999 Kurtz et al.
D408,893 S 4/1999 Tse
D409,276 S 5/1999 Ratzlaff
D410,276 S 5/1999 Ben-Tsur
5,918,809 A 7/1999 Simmons
5,918,811 A 7/1999 Denham et al.
D413,157 S 8/1999 Ratzlaff
5,937,905 A 8/1999 Santos
5,938,123 A 8/1999 Heitzman
5,941,462 A 8/1999 Sandor
5,947,388 A 9/1999 Woodruff
D415,247 S 10/1999 Haverstraw et al.
5,961,046 A 10/1999 Joubran

(56) References Cited

U.S. PATENT DOCUMENTS 5,967,417 A 10/1999 Mantel
5,979,776 A 11/1999 Williams
5,992,762 A 11/1999 Wang
D418,200 S 12/1999 Ben-Tsur
5,997,047 A 12/1999 Pimentel et al.
6,003,165 A 12/1999 Loyd
D418,902 S 1/2000 Haverstraw et al.
D418,903 S 1/2000 Haverstraw et al.
D418,904 S 1/2000 Milrud
6,016,975 A 1/2000 Amaduzzi
D421,099 S 2/2000 Mullenmeister
6,021,960 A 2/2000 Kehat
D422,053 S 3/2000 Brenner et al.
6,042,027 A 3/2000 Sandvik
6,042,155 A 3/2000 Lockwood
D422,336 S 4/2000 Haverstraw et al.
D422,337 S 4/2000 Chan
D423,083 S 4/2000 Haug et al.
D423,110 S 4/2000 Cipkowski
D424,160 S 5/2000 Haug et al.
D424,161 S 5/2000 Haug et al.
D424,162 S 5/2000 Haug et al.
D424,163 S 5/2000 Haug et al.
D426,290 S 6/2000 Haug et al.
D427,661 S 7/2000 Haverstraw et al.
D428,110 S 7/2000 Haug et al.
D428,125 S 7/2000 Chan
6,085,780 A 7/2000 Morris
D430,267 S 8/2000 Milrud et al.
6,095,801 A 8/2000 Spiewak
D430,643 S 9/2000 Tse
6,113,002 A 9/2000 Finkbeiner
6,123,272 A 9/2000 Havican et al.
6,123,308 A 9/2000 Faisst
D432,624 S 10/2000 Chan
D432,625 S 10/2000 Chan
D433,096 S 10/2000 Tse
D433,097 S 10/2000 Tse
6,126,091 A 10/2000 Heitzman
6,126,290 A 10/2000 Veigel
D434,109 S 11/2000 Ko
6,164,569 A 12/2000 Hollinshead et al.
6,164,570 A 12/2000 Smeltzer
D435,889 S 1/2001 Ben-Tsur et al.
D439,305 S 3/2001 Slothower
6,199,580 B1 3/2001 Morris
6,202,679 B1 3/2001 Titus
D440,276 S 4/2001 Slothower
D440,277 S 4/2001 Slothower
D440,278 S 4/2001 Slothower
D441,059 S 4/2001 Fleischmann
6,209,799 B1 4/2001 Finkbeiner
D443,025 S 5/2001 Kollmann et al.
D443,026 S 5/2001 Kollmann et al.
D443,027 S 5/2001 Kollmann et al.
D443,029 S 5/2001 Kollmann et al.
6,223,998 B1 5/2001 Heitzman
6,230,984 B1 5/2001 Jager
6,230,988 B1 5/2001 Chao et al.
6,230,989 B1 5/2001 Haverstraw et al.
D443,335 S 6/2001 Andrus
D443,336 S 6/2001 Kollmann et al.
D443,347 S 6/2001 Gottwald
6,241,166 B1 6/2001 Overington et al.
6,250,572 B1 6/2001 Chen
D444,846 S 7/2001 Cross
D444,865 S 7/2001 Gottwald
D445,871 S 7/2001 Fan
6,254,014 B1 7/2001 Clearman et al.
6,270,278 B1 8/2001 Mauro
6,276,004 B1 8/2001 Bertrand et al.
6,283,447 B1 9/2001 Fleet
6,286,764 B1 9/2001 Garvey et al.
D449,673 S 10/2001 Kollmann et al.
D450,370 S 11/2001 Wales et al.
D450,805 S 11/2001 Lindholm et al.
D450,806 S 11/2001 Lindholm et al.
D450,807 S 11/2001 Lindholm et al.
D451,169 S 11/2001 Lindholm et al.
D451,170 S 11/2001 Lindholm et al.
D451,171 S 11/2001 Lindholm et al.
D451,172 S 11/2001 Lindholm et al.
6,321,777 B1 11/2001 Wu
6,322,006 B1 11/2001 Guo
D451,583 S 12/2001 Lindholm et al.
D451,980 S 12/2001 Lindholm et al.
D452,553 S 12/2001 Lindholm et al.
D452,725 S 1/2002 Lindholm et al.
D452,897 S 1/2002 Gillette et al.
6,336,764 B1 1/2002 Liu
6,338,170 B1 1/2002 De Simone
D453,369 S 2/2002 Lobermeier
D453,370 S 2/2002 Lindholm et al.
D453,551 S 2/2002 Lindholm et al.
6,349,735 B2 2/2002 Gul
D454,617 S 3/2002 Curbbun et al.
D454,938 S 3/2002 Lord
6,375,342 B1 4/2002 Koren et al.
D457,937 S 5/2002 Lindholm et al.
6,382,531 B1 5/2002 Tracy
D458,348 S 6/2002 Mullenmeister
6,412,711 B1 7/2002 Fan
D461,224 S 8/2002 Lobermeier
D461,878 S 8/2002 Green et al.
6,450,425 B1 9/2002 Chen
6,454,186 B2 9/2002 Haverstraw et al.
6,463,658 B1 10/2002 Larsson
6,464,265 B1 10/2002 Mikol
D465,552 S 11/2002 Tse
D465,553 S 11/2002 Singtoroj
6,484,952 B2 11/2002 Koren
6,488,401 B1 * 12/2002 Seaman ..... B01F 5/0243 366/168.2
D468,800 S 1/2003 Tse
D469,165 S 1/2003 Lim
6,502,796 B1 1/2003 Wales
6,508,415 B2 1/2003 Wang
6,511,001 B1 1/2003 Huang
D470,219 S 2/2003 Schweitzer
6,516,070 B2 2/2003 Macey
D471,253 S 3/2003 Tse
D471,953 S 3/2003 Colligan et al.
6,533,194 B2 3/2003 Marsh et al.
6,537,455 B2 3/2003 Farley
D472,958 S 4/2003 Ouyoung
6,550,697 B2 4/2003 Lai
6,585,174 B1 7/2003 Huang
6,595,439 B1 7/2003 Chen
6,607,148 B1 8/2003 Marsh et al.
6,611,971 B1 9/2003 Antoniello et al.
6,637,676 B2 10/2003 Zieger et al.
6,641,057 B2 11/2003 Thomas et al.
D483,837 S 12/2003 Fan
6,659,117 B2 12/2003 Gilmore
6,659,372 B2 12/2003 Marsh et al.
D485,887 S 1/2004 Luettgen et al.
D486,888 S 2/2004 Lobermeier
6,691,338 B2 2/2004 Zieger
6,691,933 B1 2/2004 Bosio
D487,301 S 3/2004 Haug et al.
D487,498 S 3/2004 Blomstrom
6,701,953 B2 3/2004 Agosta
6,715,699 B1 4/2004 Greenberg et al.
6,719,218 B2 4/2004 Cool et al.
D489,798 S 5/2004 Hunt
D490,498 S 5/2004 Golichowski
6,736,336 B2 5/2004 Wong
6,739,523 B2 5/2004 Haverstraw et al.
6,739,527 B1 5/2004 Chung
D492,004 S 6/2004 Haug et al.
D492,007 S 6/2004 Kollmann et al.
6,742,725 B1 6/2004 Fan
D493,208 S 7/2004 Lin
D493,864 S 8/2004 Haug et al.

(56) References Cited

U.S. PATENT DOCUMENTS

D494,655 S 8/2004 Lin
D494,661 S 8/2004 Zieger et al.
D495,027 S 8/2004 Mazzola
6,776,357 B1 8/2004 Naito
6,789,751 B1 9/2004 Fan
D496,987 S 10/2004 Glunk
D497,974 S 11/2004 Haug et al.
D498,514 S 11/2004 Haug et al.
D500,121 S 12/2004 Blomstrom
6,827,039 B1 12/2004 Nelson
D500,549 S 1/2005 Blomstrom
D501,242 S 1/2005 Blomstrom
D502,760 S 3/2005 Zieger et al.
D502,761 S 3/2005 Zieger et al.
D503,211 S 3/2005 Lin
D503,463 S 3/2005 Hughes et al.
6,860,437 B1 3/2005 Amendt et al.
6,863,227 B2 3/2005 Wollenberg et al.
6,869,030 B2 3/2005 Blessing et al.
D503,774 S 4/2005 Zieger
D503,775 S 4/2005 Zieger
D503,966 S 4/2005 Zieger
6,899,292 B2 5/2005 Titinet
D506,243 S 6/2005 Wu
D507,037 S 7/2005 Wu
6,935,581 B2 8/2005 Titinet
D509,280 S 9/2005 Bailey et al.
D509,563 S 9/2005 Bailey et al.
D510,123 S 9/2005 Tsai
D511,809 S 11/2005 Haug et al.
D512,119 S 11/2005 Haug et al.
6,981,661 B1 1/2006 Chen
D516,169 S 2/2006 Wu
7,000,854 B2 2/2006 Malek et al.
7,004,409 B2 2/2006 Okubo
7,004,410 B2 2/2006 Li
D520,109 S 5/2006 Wu
7,040,554 B2 5/2006 Drennow
7,048,210 B2 5/2006 Clark
7,055,767 B1 6/2006 Ko
D525,341 S 7/2006 Bossini
7,070,125 B2 7/2006 Williams et al.
7,077,342 B2 7/2006 Lee
D527,440 S 8/2006 Macan
7,093,780 B1 8/2006 Chung
7,097,122 B1 8/2006 Farley
D527,790 S 9/2006 Hughes et al.
D528,631 S 9/2006 Gillette et al.
7,100,845 B1 9/2006 Hsieh
7,111,795 B2 9/2006 Thong
7,111,798 B2 9/2006 Thomas et al.
D530,389 S 10/2006 Glenslak et al.
D530,392 S 10/2006 Tse
D531,259 S 10/2006 Hsieh
7,114,666 B2 10/2006 Luettgen et al.
D533,253 S 12/2006 Luettgen et al.
D534,239 S 12/2006 Dingler et al.
D535,354 S 1/2007 Wu
D536,060 S 1/2007 Sadler
7,156,325 B1 1/2007 Chen
7,182,043 B1 2/2007 Nelson
D538,391 S 3/2007 Mazzola
D540,424 S 4/2007 Kirar
D540,425 S 4/2007 Endo et al.
D540,426 S 4/2007 Cropelli
D540,427 S 4/2007 Bouroullec et al.
D542,391 S 5/2007 Gilbert
D542,393 S 5/2007 Haug et al.
D544,573 S 6/2007 Dingler et al.
7,229,031 B2 6/2007 Schmidt
7,243,863 B2 7/2007 Glunk
7,246,760 B2 7/2007 Marty et al.
D552,713 S 10/2007 Rexach
7,278,591 B2 10/2007 Clearman et al.
D556,295 S 11/2007 Genord et al.
7,299,510 B2 11/2007 Tsai
D557,763 S 12/2007 Schonherr et al.
D557,764 S 12/2007 Schonherr et al.
D557,765 S 12/2007 Schonherr et al.
D558,301 S 12/2007 Hoernig
7,303,151 B2 12/2007 Wu
D559,357 S 1/2008 Wang et al.
D559,945 S 1/2008 Patterson et al.
D560,269 S 1/2008 Tse
D562,937 S 2/2008 Schonherr et al.
D562,938 S 2/2008 Blessing
D562,941 S 2/2008 Pan
7,331,536 B1 2/2008 Zhen et al.
7,347,388 B2 3/2008 Chung
D565,699 S 4/2008 Berberet
D565,702 S 4/2008 Daunter et al.
D565,703 S 4/2008 Lammel et al.
D566,228 S 4/2008 Neagoe
D566,229 S 4/2008 Rexach
D567,328 S 4/2008 Spangler et al.
D567,335 S 4/2008 Huang
7,360,723 B2 4/2008 Lev
7,364,097 B2 4/2008 Okuma
7,374,112 B1 5/2008 Bulan et al.
7,384,007 B2 6/2008 Ho
D577,099 S 9/2008 Leber
D577,793 S 9/2008 Leber
D578,604 S 10/2008 Wu et al.
D578,605 S 10/2008 Wu et al.
D578,608 S 10/2008 Wu et al.
D580,012 S 11/2008 Quinn et al.
D580,513 S 11/2008 Quinn et al.
D581,013 S 11/2008 Citterio
D581,014 S 11/2008 Quinn et al.
D586,426 S 2/2009 Schoenherr et al.
7,503,345 B2 3/2009 Paterson et al.
D590,048 S 4/2009 Leber et al.
7,520,448 B2 4/2009 Luettgen et al.
D592,276 S 5/2009 Shoenherr et al.
D592,278 S 5/2009 Leber
7,537,175 B2 5/2009 Miura et al.
D600,777 S 9/2009 Whitaker et al.
D603,935 S 11/2009 Leber
7,617,990 B2 11/2009 Huffman
D605,731 S 12/2009 Leber
D606,623 S 12/2009 Whitaker et al.
D606,626 S 12/2009 Zore
D608,412 S 1/2010 Barnard et al.
D608,413 S 1/2010 Barnard et al.
D616,061 S 5/2010 Whitaker et al.
7,721,363 B2 5/2010 Huang
7,721,979 B2 5/2010 Mazzola
D617,419 S 6/2010 Lee
D617,873 S 6/2010 Lee
7,740,186 B2 6/2010 Macan et al.
D621,904 S 8/2010 Yoo et al.
D621,905 S 8/2010 Yoo et al.
7,770,820 B2 8/2010 Clearman et al.
7,770,822 B2 8/2010 Leber
D624,156 S 9/2010 Leber
7,789,326 B2 9/2010 Luettgen et al.
D625,776 S 10/2010 Williams
7,832,662 B2 11/2010 Gallo
D628,676 S 12/2010 Lee
D629,867 S 12/2010 Rexach et al.
7,871,020 B2 1/2011 Nelson et al.
D641,830 S 7/2011 Alexander
D641,831 S 7/2011 Williams
8,020,787 B2 9/2011 Leber
8,020,788 B2 9/2011 Luettgen et al.
8,028,935 B2 10/2011 Leber
D652,108 S 1/2012 Eads
D652,110 S 1/2012 Nichols
D652,114 S 1/2012 Yoo
D652,894 S 1/2012 Nichols
8,109,450 B2 2/2012 Luettgen et al.
D656,582 S 3/2012 Flowers et al.
8,132,745 B2 3/2012 Leber et al.
8,146,838 B2 4/2012 Luettgen et al.

(56) References Cited

U.S. PATENT DOCUMENTS

| | | | |
|---|---|---|---|
| 8,220,726 | B2 | 7/2012 | Qui et al. |
| D667,531 | S | 9/2012 | Romero et al. |
| D669,158 | S | 10/2012 | Flowers et al. |
| 8,292,200 | B2 | 10/2012 | Macan et al. |
| 8,297,534 | B2 | 10/2012 | Li et al. |
| D672,433 | S | 12/2012 | Yoo et al. |
| D673,649 | S | 1/2013 | Quinn et al. |
| D674,047 | S | 1/2013 | Yoo et al. |
| D674,050 | S | 1/2013 | Quinn et al. |
| 8,348,181 | B2 | 1/2013 | Whitaker |
| 8,366,024 | B2 | 2/2013 | Leber |
| D678,463 | S | 3/2013 | Quinn et al. |
| D678,467 | S | 3/2013 | Quinn et al. |
| 8,640,973 | B2 | 2/2014 | Gansebom |
| D737,931 | S | 9/2015 | Schoenherr |
| D744,612 | S | 12/2015 | Peterson |
| 9,295,997 | B2 | 3/2016 | Harwanko et al. |
| D755,346 | S | 5/2016 | Yan |
| 9,387,493 | B2 | 7/2016 | Lev |
| 9,399,860 | B2 | 7/2016 | Lev |
| D778,402 | S | 2/2017 | Schoenherr |
| D778,403 | S | 2/2017 | Schoenherr |
| D778,404 | S | 2/2017 | Schoenherr |
| 10,265,710 | B2 | 4/2019 | Cacka et al. |
| 2001/0042797 | A1 | 11/2001 | Shrigley |
| 2002/0109023 | A1 | 8/2002 | Thomas et al. |
| 2003/0042332 | A1 | 3/2003 | Lai |
| 2003/0062426 | A1 | 4/2003 | Gregory et al. |
| 2003/0121993 | A1 | 7/2003 | Haverstraw et al. |
| 2004/0074993 | A1 | 4/2004 | Thomas et al. |
| 2004/0118949 | A1 | 6/2004 | Marks |
| 2004/0217209 | A1 | 11/2004 | Bui |
| 2004/0244105 | A1 | 12/2004 | Tsai |
| 2005/0001072 | A1 | 1/2005 | Bolus et al. |
| 2005/0284967 | A1 | 12/2005 | Korb |
| 2006/0016908 | A1 | 1/2006 | Chung |
| 2006/0016913 | A1 | 1/2006 | Lo |
| 2006/0102747 | A1 | 5/2006 | Ho |
| 2006/0163391 | A1 | 7/2006 | Schorn |
| 2006/0219822 | A1 | 10/2006 | Miller et al. |
| 2006/0272086 | A1 | 12/2006 | Mesa |
| 2007/0040054 | A1 | 2/2007 | Farzan |
| 2007/0200013 | A1 | 8/2007 | Hsiao |
| 2007/0246577 | A1 | 10/2007 | Leber |
| 2007/0252021 | A1 | 11/2007 | Cristina |
| 2007/0272770 | A1 | 11/2007 | Leber et al. |
| 2008/0073449 | A1 | 3/2008 | Haynes et al. |
| 2008/0083844 | A1 | 4/2008 | Leber et al. |
| 2008/0121293 | A1 | 5/2008 | Leber et al. |
| 2008/0121771 | A1 | 5/2008 | Sen et al. |
| 2008/0156897 | A1 | 7/2008 | Leber |
| 2008/0156902 | A1 | 7/2008 | Luettgen et al. |
| 2008/0223957 | A1 | 9/2008 | Schorn |
| 2008/0272591 | A1 | 11/2008 | Leber |
| 2009/0039181 | A1 | 2/2009 | Auer, Jr. |
| 2009/0200404 | A1 | 8/2009 | Cristina |
| 2009/0218420 | A1 | 9/2009 | Mazzola |
| 2009/0307836 | A1 | 12/2009 | Blattner et al. |
| 2010/0127096 | A1* | 5/2010 | Leber ..... B05B 3/04 239/101 |
| 2010/0258695 | A1 | 10/2010 | Wu |
| 2010/0320295 | A1 | 12/2010 | Mang |
| 2011/0000983 | A1 | 1/2011 | Chang |
| 2011/0011953 | A1 | 1/2011 | MacAn et al. |
| 2011/0073678 | A1 | 3/2011 | Qiu et al. |
| 2011/0121098 | A1 | 5/2011 | Luettgen et al. |
| 2011/0179566 | A1 | 7/2011 | Yang |
| 2012/0048968 | A1 | 3/2012 | Williams |
| 2012/0187320 | A1 | 7/2012 | Lu |
| 2012/0222207 | A1 | 9/2012 | Slothower et al. |
| 2013/0126646 | A1 | 5/2013 | Wu |
| 2013/0147186 | A1 | 6/2013 | Leber |
| 2014/0252138 | A1 | 9/2014 | Wischstadt et al. |
| 2014/0367482 | A1* | 12/2014 | Cacka ..... B05B 1/1654 239/11 |
| 2015/0165452 | A1 | 6/2015 | Luettgen et al. |
| 2015/0233101 | A1 | 8/2015 | Andersen |
| 2015/0211728 | A1 | 12/2015 | Zhadanov |
| 2016/0015000 | A1 | 1/2016 | Diez |
| 2018/0065131 | A1 | 3/2018 | Rogers et al. |

FOREIGN PATENT DOCUMENTS

| | | | |
|---|---|---|---|
| CH | 234284 | | 3/1963 |
| CN | 201260999 | Y | 6/2009 |
| CN | 200920182881 | | 9/2009 |
| CN | 101628263 | A | 1/2010 |
| CN | 101773880 | A | 7/2010 |
| CN | 201940296 | U | 8/2011 |
| CN | 201230021930 | | 2/2012 |
| CN | 201530310992 | | 8/2015 |
| DE | 352813 | | 5/1922 |
| DE | 848627 | | 9/1952 |
| DE | 854100 | | 10/1952 |
| DE | 2360534 | | 6/1974 |
| DE | 2806093 | | 8/1979 |
| DE | 3107808 | | 9/1982 |
| DE | 3246327 | | 6/1984 |
| DE | 3440901 | | 7/1985 |
| DE | 3706320 | | 3/1988 |
| DE | 8804236 | | 6/1988 |
| DE | 4034695 | | 5/1991 |
| DE | 19608085 | | 9/1996 |
| DE | 10034818 | A1 | 1/2002 |
| DE | 202005000881 | | 3/2005 |
| DE | 102006032017 | | 1/2008 |
| DE | 202008009530 | | 9/2008 |
| DE | 202013101201 | | 3/2013 |
| EP | 0167063 | | 6/1985 |
| EP | 0478999 | | 4/1992 |
| EP | 0514753 | | 11/1992 |
| EP | 0435030 | | 7/1993 |
| EP | 0617644 | | 10/1994 |
| EP | 0683354 | | 11/1995 |
| EP | 0687851 | | 12/1995 |
| EP | 0695907 | | 2/1996 |
| EP | 0700729 | | 3/1996 |
| EP | 0719588 | | 7/1996 |
| EP | 0721082 | | 7/1996 |
| EP | 0733747 | | 9/1996 |
| EP | 0808661 | | 11/1997 |
| EP | 0726811 | | 1/1998 |
| EP | 1921214 | | 5/2008 |
| EP | 2164642 | | 10/2010 |
| EP | 2260945 | | 12/2010 |
| FR | 538538 | | 6/1922 |
| FR | 873808 | | 7/1942 |
| FR | 1039750 | | 10/1953 |
| FR | 1098836 | | 8/1955 |
| FR | 2591099 | | 6/1987 |
| FR | 2596492 | | 10/1987 |
| FR | 2695452 | | 3/1994 |
| GB | 10086 | | 4/1894 |
| GB | 3314 | | 12/1914 |
| GB | 129812 | | 7/1919 |
| GB | 204600 | | 10/1923 |
| GB | 634483 | | 3/1950 |
| GB | 971866 | | 10/1964 |
| GB | 1111126 | | 4/1968 |
| GB | 2066074 | | 1/1980 |
| GB | 2066704 | | 7/1981 |
| GB | 2068778 | | 8/1981 |
| GB | 2121319 | | 12/1983 |
| GB | 2155984 | | 10/1985 |
| GB | 2156932 | A | 10/1985 |
| GB | 2199771 | | 7/1988 |
| GB | 2298595 | | 11/1996 |
| GB | 2337471 | | 11/1999 |
| IT | 327400 | | 7/1935 |
| IT | 350359 | | 7/1937 |
| IT | 563459 | | 5/1957 |
| JP | S63-181459 | | 11/1988 |
| JP | H2-78660 | | 6/1990 |
| JP | 4062238 | | 2/1992 |

(56) References Cited

FOREIGN PATENT DOCUMENTS

| | | | |
|---|---|---|---|
| JP | 4146708 | | 5/1992 |
| JP | 2004278194 | A | 10/2004 |
| NL | 8902957 | | 6/1991 |
| WO | WO93/12894 | | 7/1993 |
| WO | WO93/25839 | | 12/1993 |
| WO | WO96/00617 | | 1/1996 |
| WO | WO98/30336 | | 7/1998 |
| WO | WO99/59726 | | 11/1999 |
| WO | WO00/10720 | | 3/2000 |
| WO | WO08/082699 | | 7/2008 |
| WO | WO10/04593 | | 1/2010 |

OTHER PUBLICATIONS

Color Copy, Labeled 1A, Gemlo, available at least as early as Dec. 2, 1998.
Color Copy, Labeled 1B, Gemlo, available at least as early as Dec. 2, 1998.
International Search Report, PCT/US07/88962, 9 pages, dated Jun. 10, 2008.
International Search Report, PCT/US07/67141, 8 pages, dated Jul. 2, 2008.
EZ Wash Wand, accessed at least as early as Feb. 2016, http://www.ezwashwand.com.
WashWands, accessed at least as early as Feb. 2016, http://www.washwand.com.
Woof Washer, accessed at least as early as Feb. 2016, http://www.woofwasher.com.

* cited by examiner

SHOWERHEAD WITH DUAL OSCILLATING MASSAGE

CROSS REFERENCE TO RELATED APPLICATIONS

The present application is a divisional of U.S. patent application Ser. No. 15/483,742 filed on Apr. 10, 2017 and entitled "Showerhead with Dual Oscillating Massage", which claims priority to U.S. Provisional Application No. 62/323,219 filed in Apr. 15, 2016 entitled "Showerhead with Dual Oscillating Massage" and U.S. Provisional Application No. 62/423,650 filed Nov. 17, 2016 entitled "Showerhead with Dual Oscillating Massage," all of which are incorporated by reference herein in their entireties. The present application is related to U.S. Pat. No. 9,404,243 entitled "Showerhead with Turbine Driven Shutter," filed on Jun. 13, 2014 and U.S. patent application Ser. No. 15/208,158 entitled "Showerhead with Turbine Driven Shutter," filed on Jul. 12, 2016, both of which are incorporated by reference herein in their entireties.

TECHNICAL FIELD

The technology disclosed herein relates generally to showerheads, and more specifically to pulsating showerheads.

BACKGROUND

Many showerheads emit pulsating streams of water in a so-called "massage" mode. Typical massage modes are achieved by rotating a shutter in a circular manner that blocks or covers nozzle apertures as it spins. Due to the circular rotation path, nozzles are opened in a sequential manner and many times a first nozzle aperture will be partially closed as the shutter rotates to close a second nozzle aperture (which will be partially open until the rotation moves the shutter further). This distributes the water across multiple nozzle outlets, reducing the force experienced by the user in the massage mode. Additionally, many massage mode nozzle outlets are arranged in a center of the showerhead and are clustered tightly together. This means that the water exiting the nozzles impacts a small surface area on the user. As such, there is need for an improved massage mode for a showerhead that increases the force experienced by a user, expands the impact area on a user's body, or both.

The information included in this Background section of the specification, including any references cited herein and any description or discussion thereof, is included for technical reference purposes only and is not to be regarded subject matter by which the scope of the invention is to be bound.

SUMMARY

In one embodiment, a massage mode assembly for a showerhead is disclosed. The massage mode assembly includes a drive element, a cam, and a shutter. The drive element has a drive element length or diameter, depending on the shape of the drive element, and is rotatable about an axis by fluid flowing through the showerhead. The cam is connected to the drive element and rotates with the drive element. The shutter is operably engaged with the cam and has a shutter length that is longer than the drive element length and the rotation of the cam causes the shutter to move correspondingly.

In another embodiment, a showerhead for producing an oscillating pulse is disclosed. The showerhead includes a housing having an inlet in fluid communication with a fluid source and an engine received within the housing and in fluid communication with the fluid source. The engine including a turbine, a cam extend from the turbine, a shutter operably connected to the cam, a first plate in fluid communication with the inlet and a second plate in fluid communication with the inlet. The second plate includes a first group of outlet nozzles, a second group of outlet nozzles, a third group of outlet nozzles, and a fourth group of outlet nozzles. In operation, the turbine rotates as fluid flows from the inlet into the engine and as the turbine rotates, the cam rotates, moving the shutter correspondingly between a first position and a second position. In the first position of the shutter, the first group of outlet nozzles and third group of outlet nozzles are fluidly disconnected from the fluid inlet and the second group of outlet nozzles and fourth group of outlet nozzles are fluidly connected to the fluid inlet and in the second positon of the shutter, the second group of outlet nozzles and the fourth group of outlet nozzles are fluidly disconnected from the fluid inlet and the first group of outlet nozzles and the third group of outlet nozzles are fluidly connected to the fluid inlet.

In yet another embodiment, a showerhead is disclosed. The showerhead includes a housing having an inlet, a faceplate connected to the housing and defining a plurality of nozzles, and a massage mode assembly received within the housing and in fluid communication with the inlet and the plurality of nozzles. The massage mode assembly includes a turbine, a cam connected to the turbine such that rotation of the turbine causes rotation of the cam, and a shutter engaged with the cam such that rotation of the cam causes the shutter to move and as the shutter moves, one or more edge flow paths around one or more edges of the shutter are defined and one or more aperture flow paths through one or more flow apertures in the shutter are defined.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

DETAILED DESCRIPTION

Figure 1:
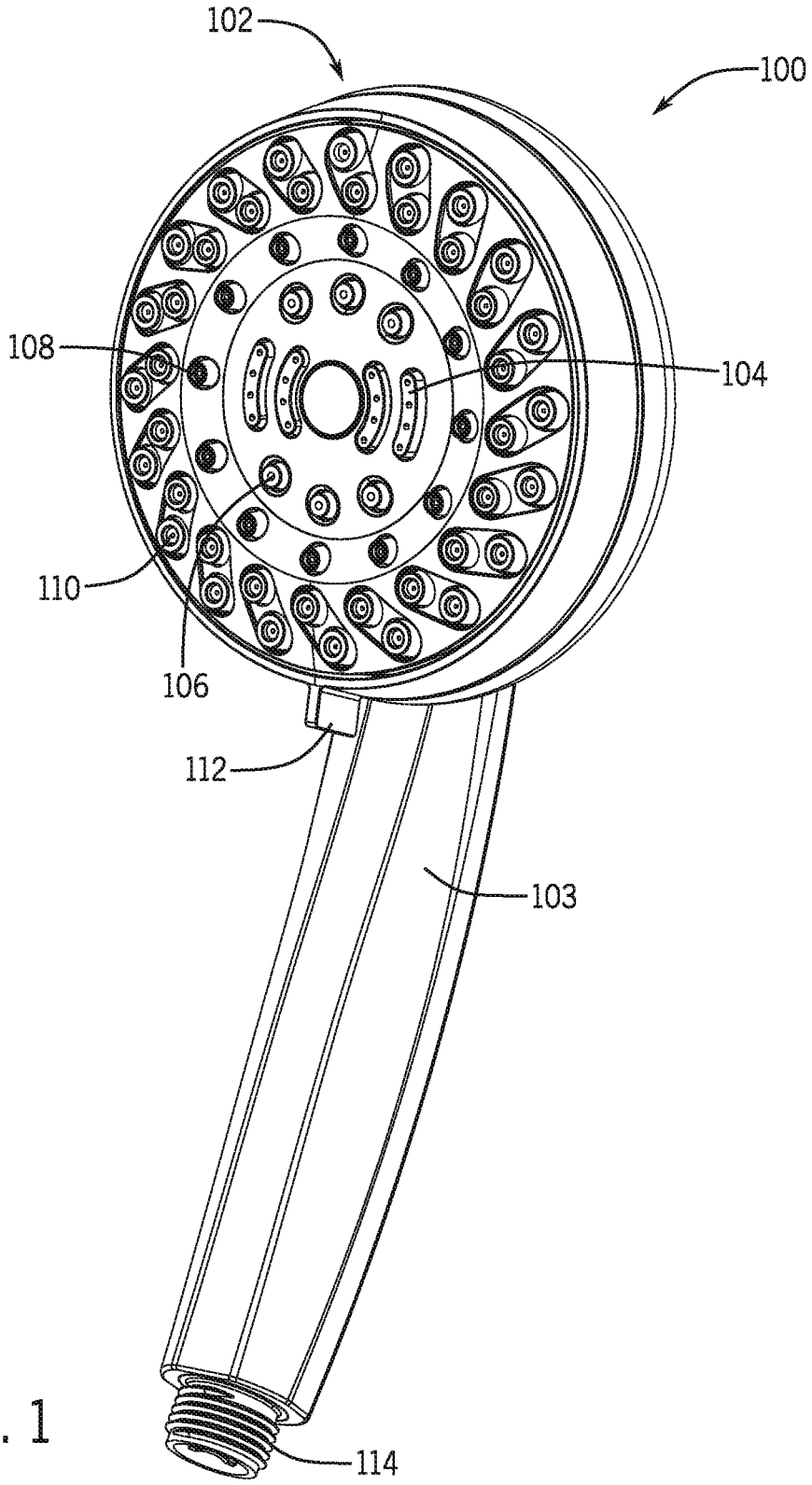
FIG. 1 is an isometric view of a showerhead including a massage mode assembly.

This disclosure is related to a showerhead including an improved pulsating or massaging spray. The massage spray is created by a massage assembly and has an increased impact area during each pulse cycle as compared to conventional massage modes, as well as an increased impact force. Additionally, the massage spray evenly divides a flow, to separate the flow to different sections of the impact area, such that the flow impacts the separate areas at substantially the same time.

In one embodiment, the massage mode or pulsating assembly includes a drive element, such as a turbine, defining a cam surface and a shutter connected to and engaged with the cam surface. In operation, water flowing through the showerhead rotates the drive element, causing the cam surface to rotate correspondingly. The shutter, which is engaged with the cam surface, acts as a cam follower and follows the movement of the cam surface. However, the movement of the shutter is constrained in one or more directions, such that the shutter will move in a reciprocating and substantially linear manner, rather than in a rotational path. As the shutter moves to a first position, one or more nozzle apertures are blocked and one or more nozzle apertures are unblocked, allowing flow therethrough. As the shutter moves to a second position, the blocked nozzle apertures are unblocked and the unblocked nozzle apertures are blocked, changing the nozzles expelling water, varying the impact location of the water on the user.

In some embodiments, the shutter is larger in at least one dimension than the drive element. For example, in one embodiment, the shutter length is longer than a diameter of the drive element such that the perimeter of the shutter extends past the perimeter of the drive element. This allows the shutter to block nozzle apertures positioned outside of a cavity containing the drive element. This allows the massage mode apertures to be positioned farther away from a center of the showerhead or other location of the drive element, increasing a spray pattern diameter for the massage mode and thus increasing a diameter of the impact area on the user.

Additionally, the showerhead may include two sets of massage mode nozzles on either side of the drive element. In these embodiments, the shutter includes flow apertures configured to allow fluid communication from the showerhead inlet with one set of massage mode nozzles on each side of the drive element, while the body of the shutter blocks the other sets of massage mode nozzles. In this manner, in the first position of the shutter, only one set of nozzles on each side of the drive element are unblocked at a time and nozzles on the same side are not open simultaneously, distributing the pulsating spray to different areas of the showerhead.

In many embodiments the nozzle groups are arranged in pairs, with the nozzle pairs being blocked and unblocked at substantially the same time. Often, the nozzle pairs are spatially separated on opposite sides of a central showerhead axis from one another. The massage mode assembly allows the pairs to be opened and closed at substantially the same time as one another, creating a more powerful pulsating stream feel, since neither set of nozzles in the pair is partially open/partially closed when the other is fully open or closed. That is, the nozzle pairs may not include "transitional" nozzles that open and close progressively.

Figure 2:
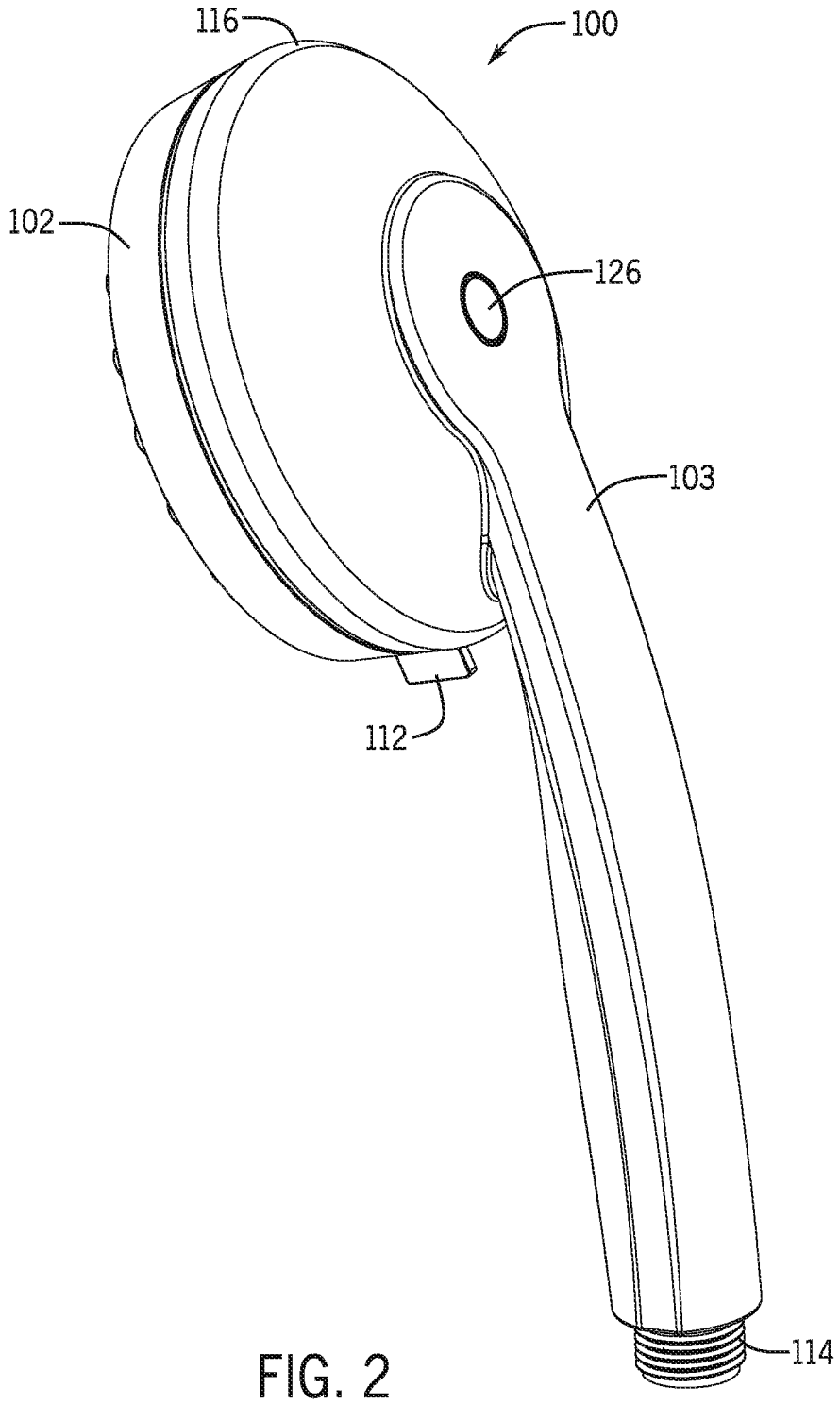
FIG. 2 is a rear isometric view of the showerhead of FIG. 1.
Figure 3:
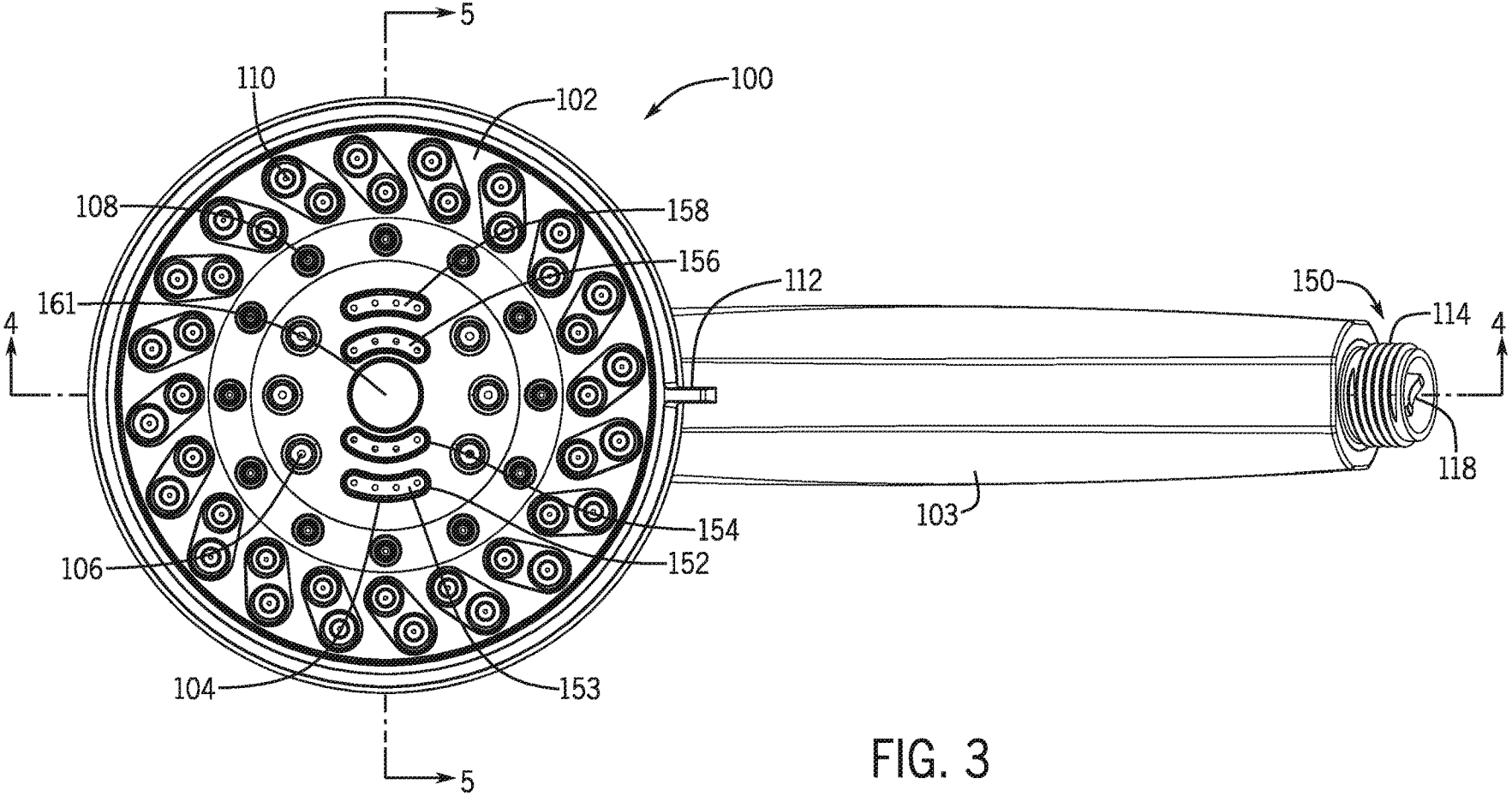
FIG. 3 is a front elevation view of the showerhead of FIG. 1.
Figure 4:
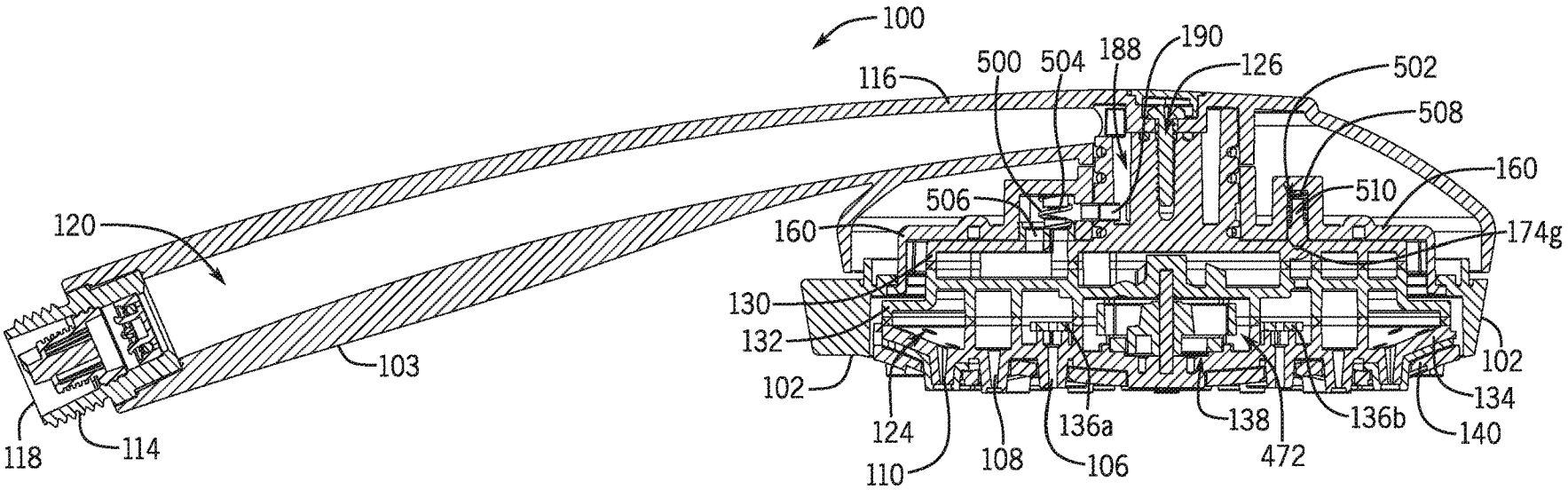
FIG. 4 is a cross-section view of the showerhead of FIG. 1 taken along line 4-4 in FIG. 3.
Figure 5:
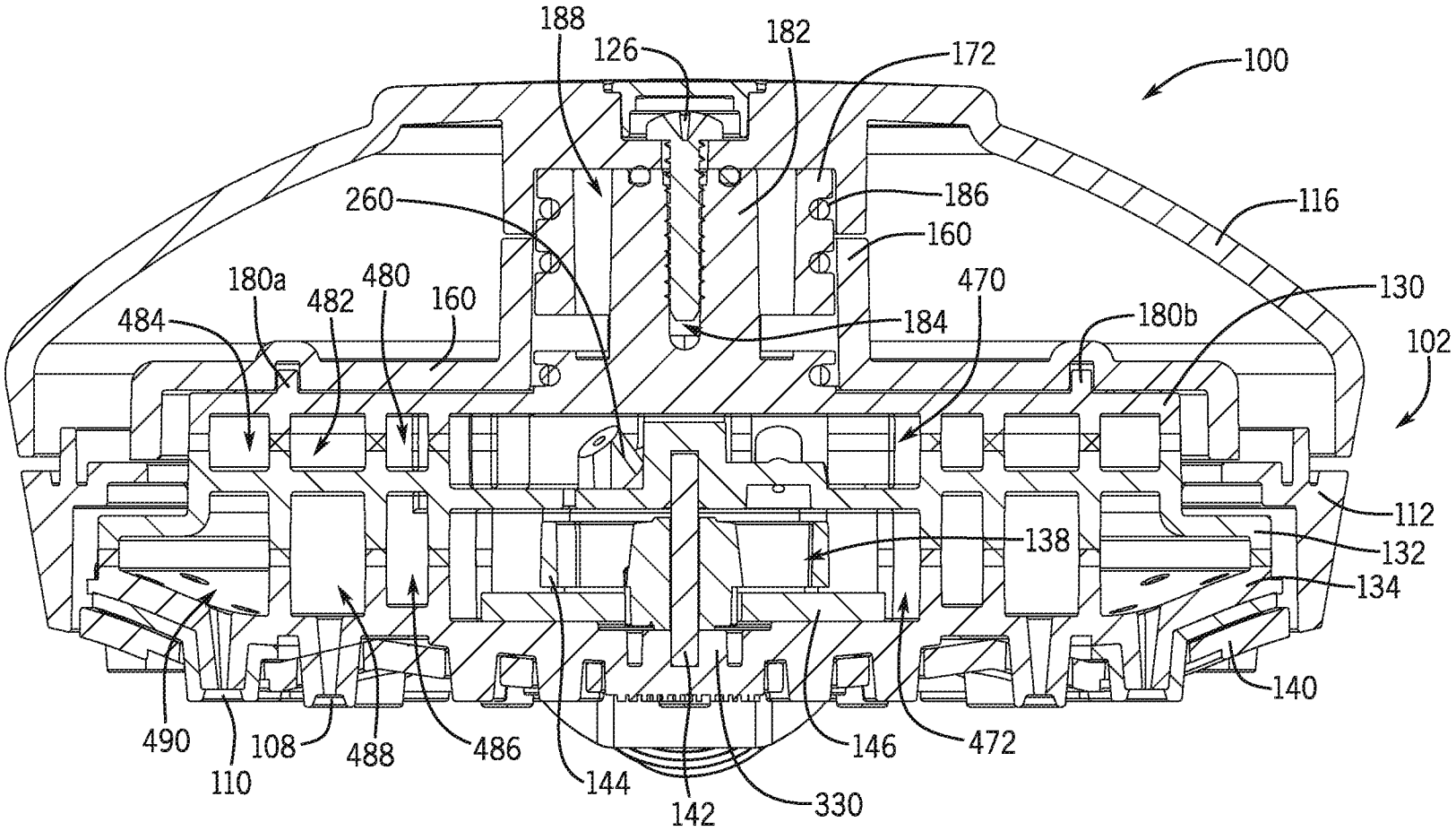
FIG. 5 is a cross-section view of the showerhead of FIG. 1 taken along line 5-5 in FIG. 3.

Turning to the figures, showerhead embodiments of the present disclosure will now be discussed in more detail. FIGS. 1-3 are various views of a showerhead including a massage module. FIGS. 4 and 5 are cross-sectional views of the showerhead of FIGS. 1-3. With reference to FIGS. 1-5, the showerhead 100 may include a handle 103 and a spray head 102. In the embodiment shown in FIGS. 1-5, the showerhead 100 is a handheld showerhead. However, in other embodiments the showerhead 100 may be a fixed or wall mount showerhead, in which case the handle 103 may be omitted or reduced in size. The handle 103 defines an inlet 150 that receives water from a fluid source, such as a hose, J-pipe, or the like. Depending on the water source, the handle 103 may include a connector 114, such as threading that can be used to secure the handle 103 to the hose, pipe, etc.

In embodiments where the showerhead 100 is a handheld showerhead, the handle 103 may be an elongated member configured to be comfortably held in a user's hand and define a handle passageway 120 in fluid communication with the inlet 150. Additionally, as shown in FIG. 4, the showerhead 100 may also include a flow regulator 118, a filter 121, or both that are connected to the handle 103.

With reference to FIGS. 1 and 3, the spray head 102 includes a plurality of output nozzles arranged in sets or groups, e.g., a first nozzle group 104, a second nozzle group 106, a third nozzle group 108, and a fourth nozzle group 110, that function as outlets for the showerhead 100. In particular, each nozzle group includes a plurality of nozzles or outlets that dispense water from the showerhead. As will be discussed in more detail below, each of the selected nozzle groups 104, 106, 108, 110 may be associated with a different mode for the showerhead 100. Additionally, certain groups of nozzles, such as the first nozzle group 104 may include multiple banks of nozzles, such as a first nozzle bank 152, a second nozzle bank 154, a third nozzle bank 156, and a fourth nozzle bank 158. In one embodiment, the nozzle banks 152, 154, 156, 158 are arranged on opposite sides from one another and positioned around a central region 160 of the spray head 102. In some embodiments the first and second nozzle banks 152, 154 may be defined as crescent or curved structures defining nozzle apertures with the first nozzle bank 152 being positioned farther away from the central region 161 and generally corresponding to a curvature of the second nozzle bank 154. The third and fourth nozzle banks 156, 158 may be similarly configured. The shape and arrangement of the nozzle banks may be aesthetically pleasing to create a symmetrical arrangement. However, in other embodiments, the nozzle banks may be differently configured, e.g., straight bars, rather than curved banks, or the like. As will be discussed in more detail below, the nozzle banks 152, 154, 156, 158 may be operated in pairs, with one nozzle bank one each side of the central region being operated simultaneously and with nozzle banks on the same side being operated at different times.

In addition to varying the shape of the nozzle banks 152, 154, 156, 158, in some embodiments, the shape of the nozzle outlets within the banks may be varied. For example, as shown in FIGS. 1 and 3, each nozzle bank 152, 154, 156, 158 includes a plurality of nozzle outlets 153, in the embodiment shown in FIG. 3, there are four nozzle outlets per bank, but other variations are envisioned. In some embodiments, the nozzle outlets 153 may be shaped as circular apertures, but in other embodiments, the size, shape, and diameter of the outlets is varied. In one embodiment, each of the outlets 153 may be shaped as oblong slots that are arranged to extend parallel or perpendicular to the extension direction of the nozzle banks themselves. Similarly, in some embodiments, the nozzle outlet shape may be varied within each nozzle bank and/or different nozzle banks may have different nozzle outlet shapes.

Figure 18A:
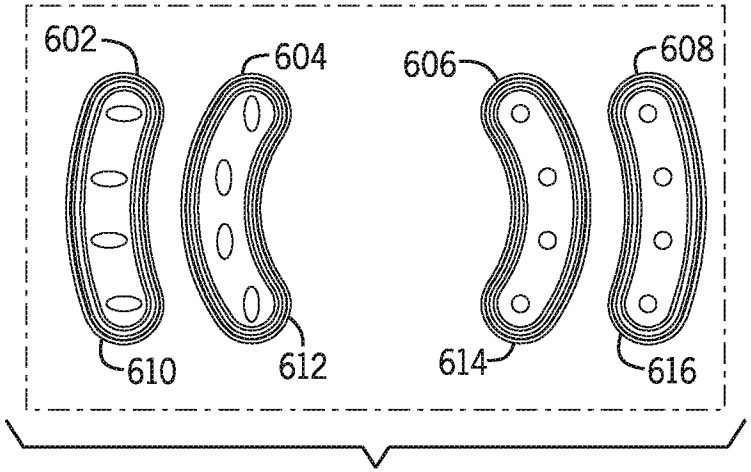
FIG. 18A illustrates alternative examples of the nozzle banks.

FIG. 18A illustrates a front plan view of various alternative examples of the nozzle banks. With reference to FIG. 18A, a first set of nozzle banks 602, 604 have a first type of nozzle outlet shape that varies from the nozzle outlet shape of the second set of nozzle banks 606, 608. By varying the shape of the nozzle outlets, the force experienced by the user can be varied and by selecting a first shape, size, or diameter of the nozzle outlets for a first side of the showerhead (e.g., first set of nozzle banks 602, 604) as compared to the second side (e.g., nozzle banks 606, 608), the user may experience a different force on different sides of his or her body. Similarly, within the groups of nozzle banks 602, 604, 606, 608, the nozzle outlets 610, 612, 614, 616 may be varied. In particular, the first group of nozzle banks 602, 604 have oval or slot shaped nozzle outlets 610, 612, whereas the second group of nozzle banks 606, 608 have circular nozzle outlets 614, 616. Other types of geometric or arbitrary shapes may be selected as well.

As shown in FIG. 18A, in the first nozzle bank group 602, 604, the first nozzle bank 602 includes slot or oval shaped nozzle outlets 610 that have a length perpendicular to a longitudinal length of the nozzle bank 602 (e.g., have a longer length in the direction of the shorter length of the nozzle bank). On the other hand, the second nozzle bank 604, has slot or oval shaped nozzle outlets 612 that have a length extending parallel to a length of the nozzle bank (e.g., a longer length in the direction of the longer length of the nozzle bank). This varying orientation will create a different feel for the user for each of the different banks. In addition to changing the shape or size of the nozzle outlets, the nozzle banks may have differing number of outlets in order to generate varying sensations on the user. For example, fewer nozzle outlets may generate a stronger force and so if one or more of the nozzle banks have fewer outlets, this could create an alternating light/strong sensation on the user.

Figure 18B:
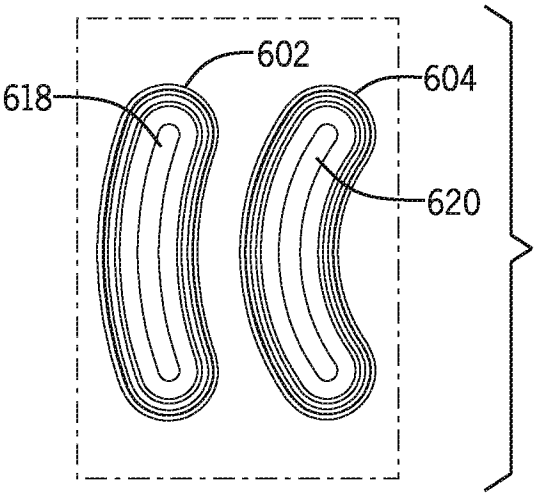
FIG. 18B illustrates another example of the nozzle outlets for the nozzle banks.

FIG. 18B illustrates another example of the nozzle outlets for the nozzle banks. As shown in FIG. 18B, in some embodiments, the multiple nozzle outlets may be replaced by a single outlet, such as the nozzle outlets 618, 620. In this example, the slot or oval shaped nozzle outlet 618, 620 extends substantially the entire length of the nozzle banks 602, 604 and may be used to generate a fan shaped spray when fluidly connected to the fluid source. It should be noted that although the nozzle banks 602, 604 are shown as being arranged in an arc, in other embodiments, the nozzle banks 602, 604 may be arranged in a straight line or other configuration and the nozzle outlet shape may vary based on the shape of the nozzle bank, such that the nozzle outlets 618, 620 may track or correspond to the shape of the nozzle bank.

With reference again to FIGS. 1-5, the showerhead mode is varied by rotating the mode selector 112, which in turn rotates a back cover 160 received within the spray head 102, moving an sealing or mode selector assembly 500 to different positions relative to an engine 124. The engine 124 defines the different flow paths for the showerhead and is connected by a connection assembly 126 to the spray head 102. Other types of mode selectors may be used, such as a fixed spray head with a movable mode ring, a rotating spray head, switch or button, or the like.

Figure 6:
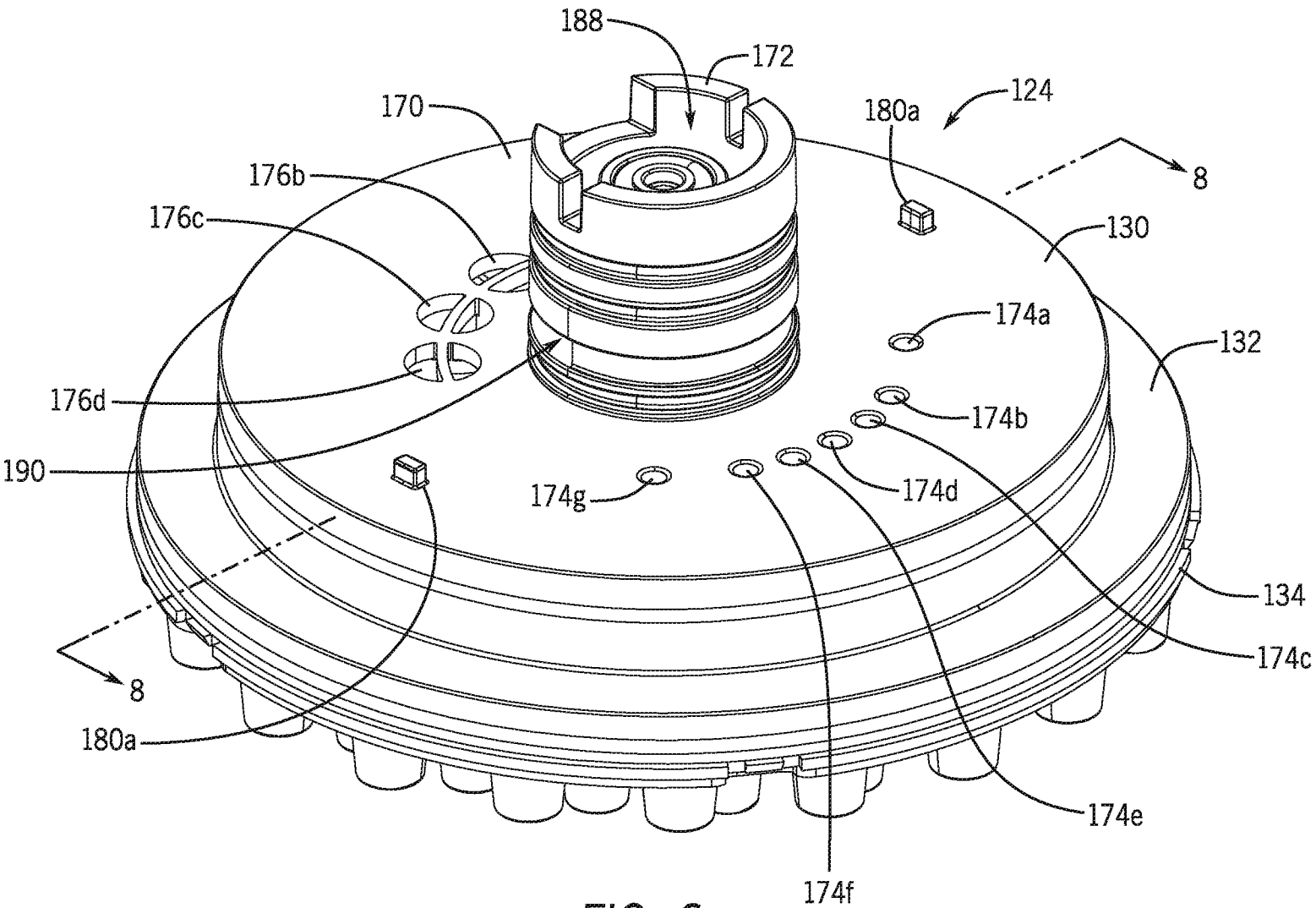
FIG. 6 is a top isometric view of an engine including the massage mode assembly for the showerhead of FIG. 1.
Figure 7:
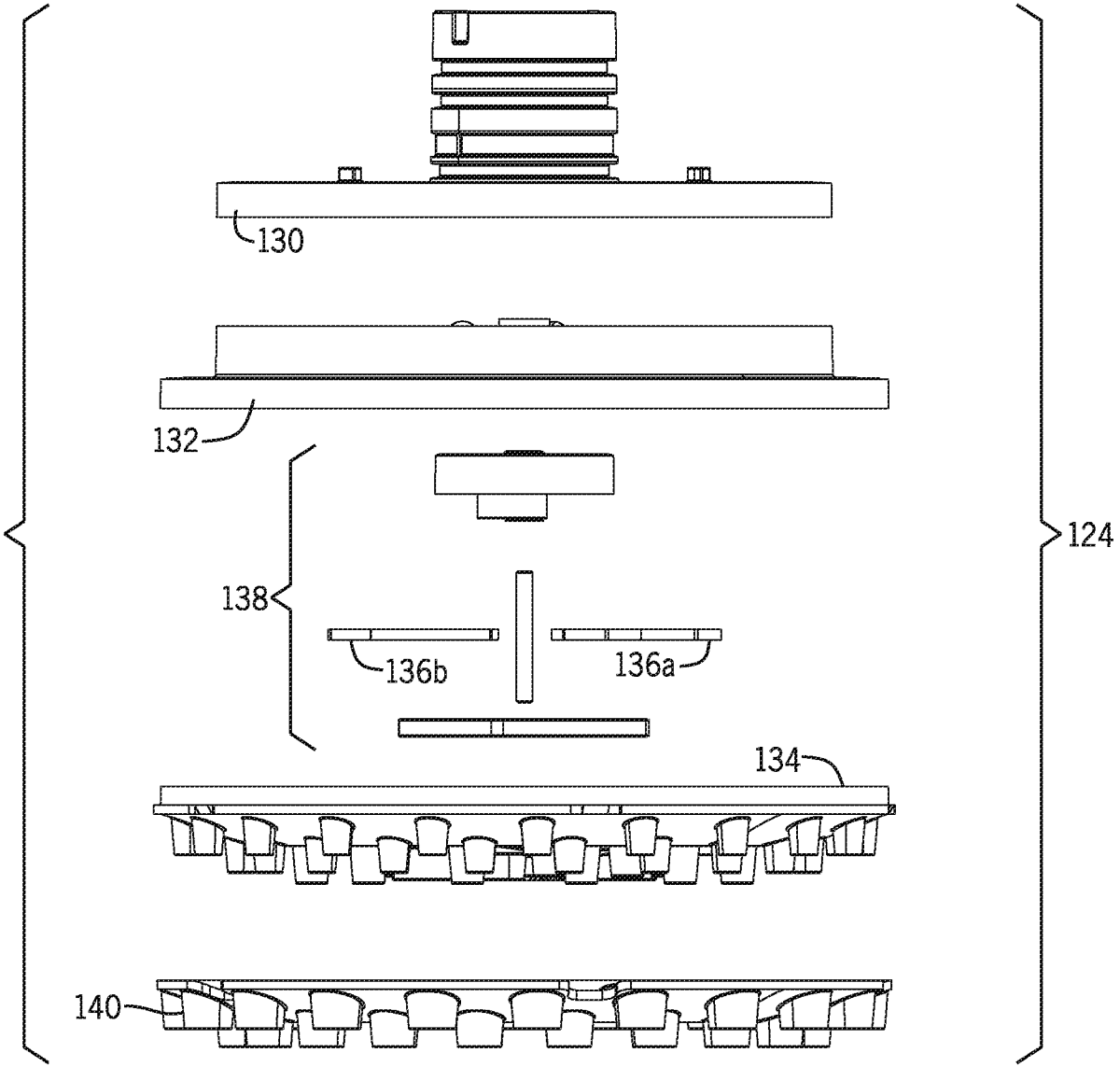
FIG. 7 is an exploded view of the engine of FIG. 6.
Figure 8:
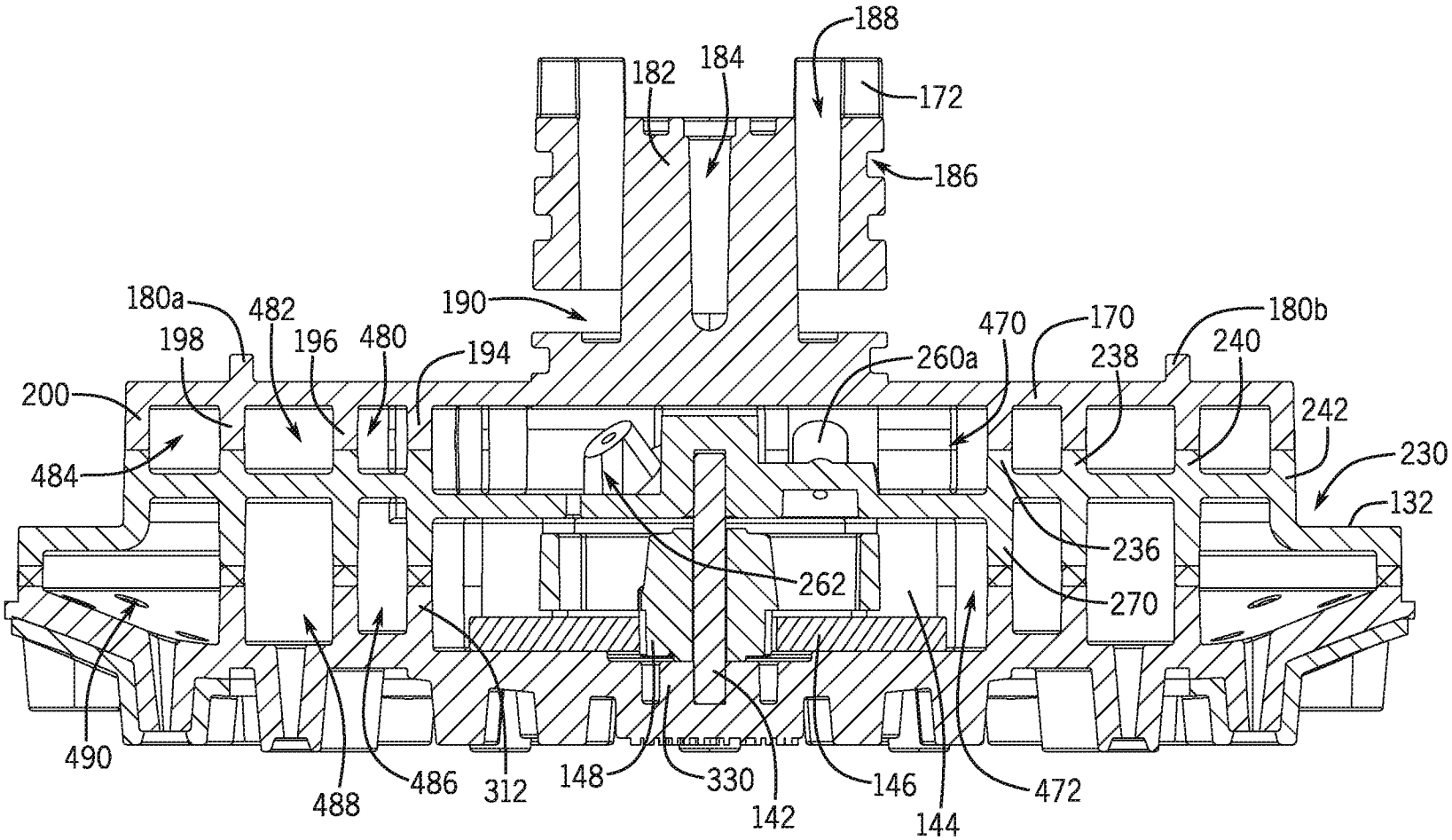
FIG. 8 is a cross-section view of the engine of FIG. 6 taken along line 8-8 in FIG. 6.

The engine 124 determines the flow characteristics of the different modes for the showerhead. The engine 124 typically includes flow control plates or levels that direct flow from the inlet 150 to different nozzle groups 104, 106, 108, 110. FIG. 6 is a top isometric view of the engine 124. FIG. 7 is an exploded view of the engine. FIG. 8 is a cross-sectional view of the engine 124 taken along line 8-8 in FIG. 6. With reference to FIGS. 6-8, the engine 124 includes a mounting plate 130, one or more jet or flow control plates 132, a face plate 134, a nozzle boot 140, a massage assembly 138, and optionally one or more mist caps 136*a*, 136*b*. The various plates and components are secured together and define multiple flow paths for water as it flows from the inlet to exit out of the nozzle groups 104, 106, 108, 110. The type, shape, and connection of the flow plates may be varied based on the type of showerhead and desired spray patterns.

Figure 9A:
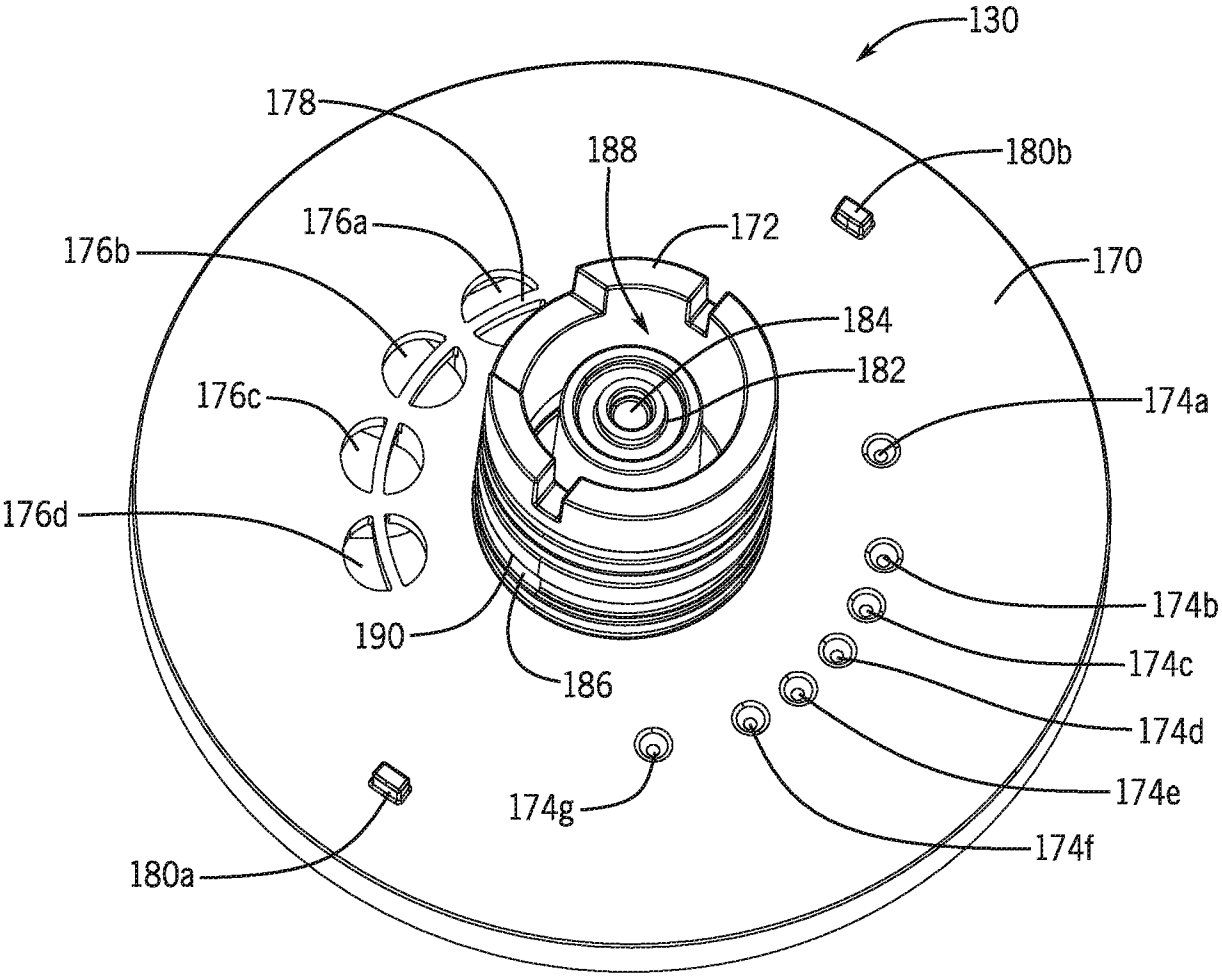
FIG. 9A is a top isometric view of a mounting plate of the engine of FIG. 6.
Figure 9B:
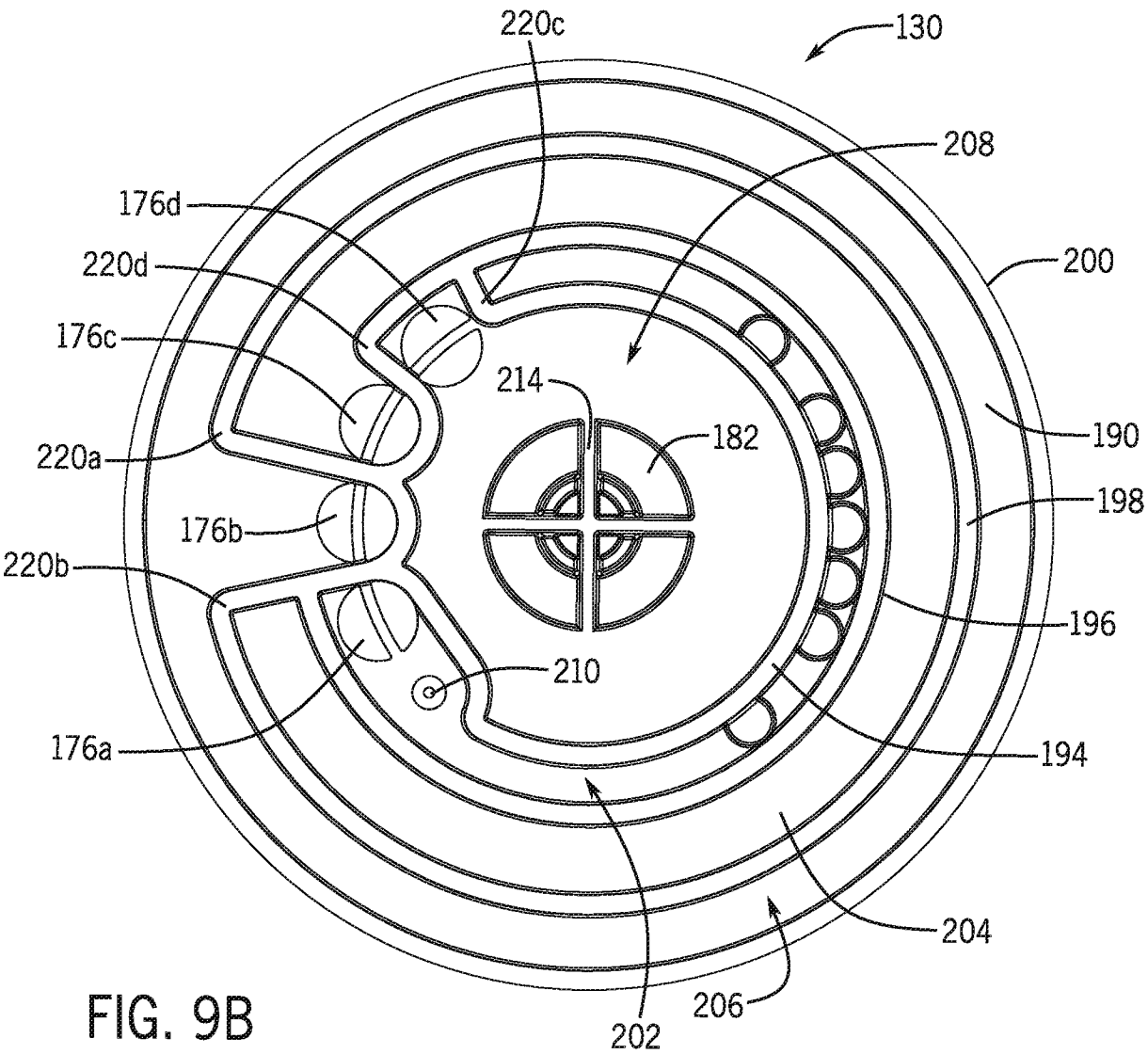
FIG. 9B is a bottom plan view of the mounting plate of FIG. 9A.

The mounting plate 130 or back plate will now be discussed in more detail. FIGS. 9A and 9B illustrate the mounting plate 130. With reference to FIGS. 8-9B, the mounting plate 130 may be a generally circularly shaped plate having a top surface 170 and bottom surface 192. An engine inlet 172 may be formed as a circular wall that extends upwards from the top surface 170 and defines an inlet lumen 188 through a portion of the engine inlet 172 (e.g., the lumen may extend along a length of the inlet 172, but a bottom wall may seal the bottom of the inlet from the interior of the mounting plate). The engine inlet 172 may include connection features, such as cutouts, tabs, or the like, that engage with corresponding structures in the housing or cover 160 to connect the mounting plate 130 to the back cover 160 or housing 116. The engine inlet 172 also may include one or more sealing grooves 186 that extend around the outer surface thereof. The sealing grooves 186 are configured to receive a sealing member, such as an O-ring, to seal the engine inlet 172 against the housing of the handle 103.

A connection shaft 182 is concentric with the engine inlet 172 and is formed within the inlet 172 such that the inlet lumen 188 is defined between the connection shaft 182 and the interior walls of the inlet 172. The connection shaft 182 may include a connection aperture 184 for engaging with a connection assembly 126 for securing the engine 124 to the housing.

With reference to FIG. 8, a plate outlet 190 is defined through an outer wall of the engine inlet 172 and is fluidly connected to the inlet lumen 188. The plate outlet 190 is fluidly coupled to a plurality of mode apertures 176*a*, 176*b*, 176*c*, 176*d* that are defined through the top surface 170 of the mounting plate 130. As will be discussed in more detail below, each of the mode apertures 176*a*, 176*b*, 167*c*, 176*d* correspond to different flow pathways within the engine 124 and thus different nozzle groups 104, 106, 108, 110 on spray head 102. Additionally, in some embodiments, each of the mode apertures 176*a*, 176*b*, 176*c*, 176*d* may include a support rib 178 that spans across the width of the aperture. The support rib 178 is used to support a sealing member that prevents water from flowing into the other mode apertures 176*a*, 176*b*, 176*c*, 176*d* when a particular mode aperture is selected.

The mounting plate 130 may also include a plurality of detent recesses 174*a*, 174*b*, 174*c*, 174*d*, 174*e*, 174*f*, 174*g*, defined on the top surface 170. The detent recesses 174*a*, 174*b*, 174*c*, 174*d*, 174*e*, 174*f*, 174*g* are used to provide feedback to a user when the engine 124 has been positioned to select a particular mode, as well as to provide some resistance to hold the engine 124 in position during operation.

Tabs 180*a*, 180*b* may also be defined on the top surface 170 of the mounting plate 130. The tabs 180*a*, 180*b* may be used to engage with a corresponding feature, such as a groove, or the like, on the back cover 160 or the interior of the housing. Additionally or alternatively the tabs 180*a*, 180*b* may act as rotational stops during mode change of the showerhead.

With reference to FIGS. 8 and 9B, the mounting plate 130 may also be used as a flow directing plate for directing water flow from the inlet to different nozzle groups. In these embodiments, the mounting plate 130 includes a plurality of channels defined by channel walls. For example, a massage channel 208 is defined by the bottom surface 192 and a first channel wall 194. The first channel wall 194 may be substantially circular and be formed on an interior of the bottom surface 192 near a central region of the mounting plate 130. A first mode channel 202 is defined between the first channel wall 194 and a second channel wall 196 that is partially parallel or concentric to the first channel wall 194. A second mode channel 204 is defined by the second channel wall 196 and a third channel wall 198. As with the other channels, the third channel wall 198 extends parallel to the second channel wall 196 for a substantial length. A third mode channel 206 is defined by the third channel wall 198 and a fourth channel wall 200, which also forms an outer wall for the mounting plate 130. Each of the channel walls, except the fourth channel wall 200, may include an end wall 220*a*, 220*b*, 220*d*, 220*c* that extends between adjacent walls. The end walls 220*a*, 220*b*, 220*c*, 220*d* define an end of the channels and also prevent fluid flowing in one channel from entering into one of the other channels.

Figure 10A:
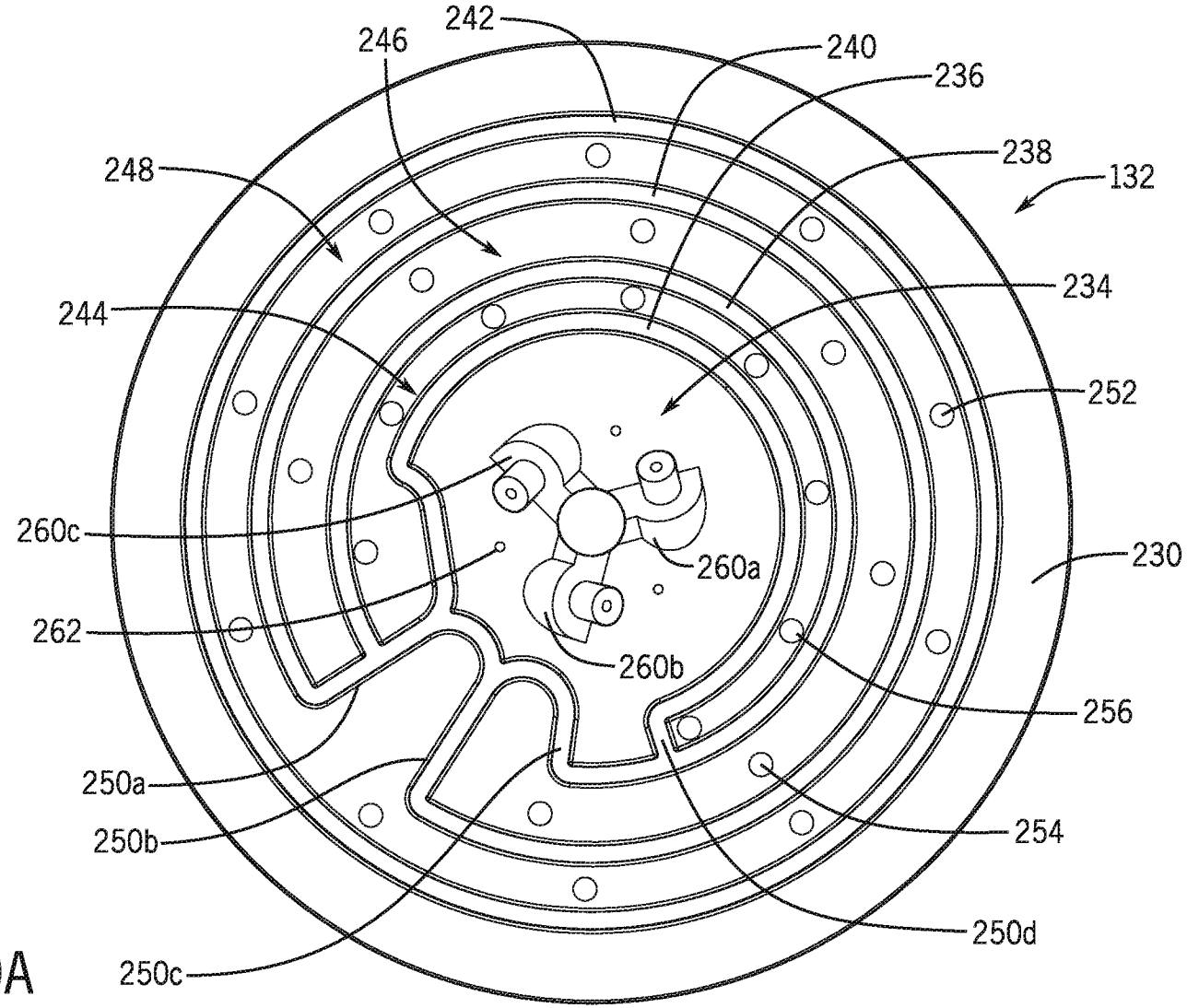
FIG. 10A is a top plan view of a jet plate of the engine of FIG. 6.
Figure 10B:
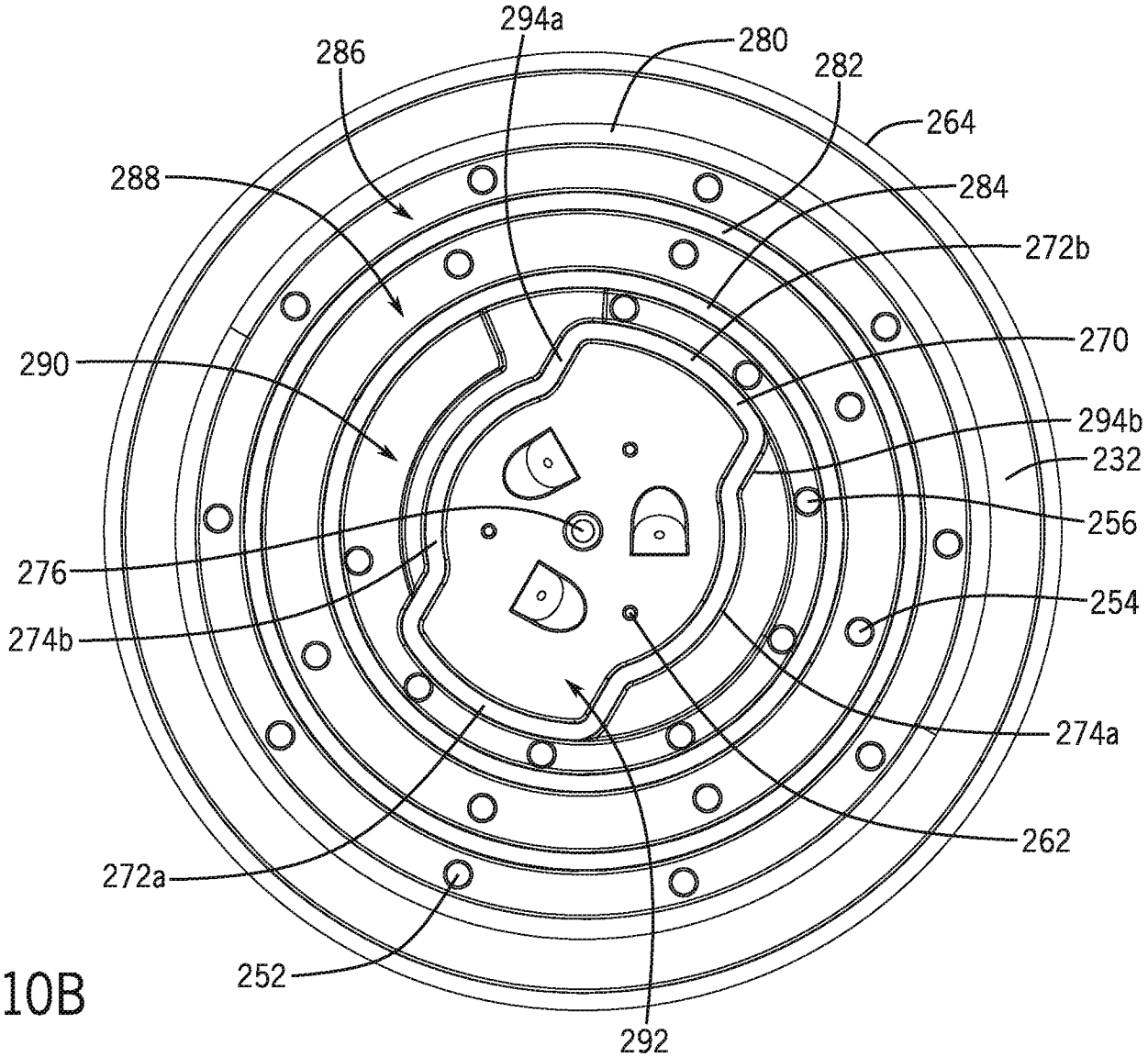
FIG. 10B is a bottom plan view of the jet plate of FIG. 10A.

FIGS. 10A and 10B illustrate various views of the jet plate 132. The jet plate 132 combines with the mounting plate 130 to define fluid flow pathways through the engine 124. The jet plate 132 integrates jets for activating the massage mode assembly 138 with a flow directing plate, reducing the number of separate components for the showerhead 100. Similar to the mounting plate 130, the jet plate 132 includes a number of walls that engage with corresponding walls on the mounting plate 130 to create the flow pathways. With reference to FIGS. 10A and 10B, the jet plate 132 may be a generally circular plate that includes walls that extend from a top surface 230 and a bottom surface 232 such that the surfaces 230, 232 form a middle section of the jet plate 132 and the walls extend from either side.

With reference to FIG. 10A, the top surface 230 includes a first mode wall 236 that is generally circular and forms on an inner portion of the surface 230 towards a center area of the jet plate 132. The first mode wall 236 encircles a jet structure including a plurality of jets 260*a*, 260*b*, 260*c* that are connected to and defined in the central region of the jet plate 132. The first mode wall 236 defines a massage channel 234 encompassing the jets 260*a*, 260*b*, 260*c*. A plurality of disruptor jets 262 is defined through the top surface 230 in the massage channel 234.

A second mode wall 238 is defined adjacent to but separated from the first mode wall 236. The second mode wall 238 may be generally concentric to the first mode wall 236 and the first and second walls 236, 238 together define a first mode channel 244. A plurality of first mode apertures 256 are defined through the top surface 230 and spaced along the first mode channel 244. A third mode wall 240 is defined adjacent to but spaced apart from the second mode wall 238. The third mode wall 240 is radially farther from a center of the plate 132 and is substantially concentric with the second mode wall 238. The second mode wall 238 and the third mode wall 240 together define a second mode channel 246 that includes a plurality of second mode apertures 254 defined through the top surface 230 of the plate 132.

A fourth mode wall 242 is adjacent to the third mode wall 240 and positioned towards a perimeter of the jet plate 132. The fourth mode wall 242 encircles the other walls and the combination of the fourth mode wall 242 and the third mode wall 240 defines a third mode channel 248 having a plurality of third mode apertures 252 defined through the top surface 230.

With reference to FIG. 10B, a plurality of channel defining walls extend from a bottom surface 232 of the jet plate 132. An outer lip or outer wall 264 extends around the perimeter of the plate 132. A fourth mode wall 280 is concentric with but spaced radially inwards from the outer wall 264. Similarly, third and second mode walls 282, 284 are concentric with the fourth mode wall 280 but each is positioned radially inwards relative to the adjacent wall. The combination of the walls defines different mode channels that deliver fluid to select groups of nozzles. The fourth mode wall 280 and the third mode wall 282 together define the third mode channel 286 that is in fluid communication with the flow apertures 252. The third mode wall 282 and the second mode wall 284 together define the second mode channel 288 that is in fluid communication with second mode apertures 254. The second mode wall 284 and a massage mode wall 270 define the first mode channel 290 that is in fluid communication with the flow apertures 256.

With continued reference to FIG. 10B, the jet plate 132 defines a massage chamber 292 for receiving components of the massage assembly 138. The chamber 292 is defined by a massage mode wall 270 or track that includes two end walls 272*a*, 272*b* and two sidewalls 274*a*, 274*b*. In one embodiment, the end walls 272*a*, 272*b* form bumpers for the shutter 146 as discussed in more detail below. In these embodiments, the end walls 272*a*, 272*b* may be shaped as brackets and have a slightly curved shape. The curvature of the end walls 272*a*, 272*b* may be selected to match a sidewall curvature of the shutter 146 for the massage assembly 138. The sidewalls 274*a*, 274*b* include restraining segments 294*a*, 294*b* that are straight walls that transition to form the end walls 272*a*, 273*b*. The restraining segments 294*a*, 294*b* restrain movement of the massage assembly and define the movement path of the shutter. A middle section of the sidewalls 274*a*, 274*b* may be curved and extend outwards from a center of the jet plate 132. For example, the middle section of the sidewalls 274*a*, 274*b* may be convexly curved and configured to receive a drive element of the massage assembly 138. A pin recess 276 may be defined in a center of the massage chamber 292 and configured to receive and secure portions of the massage assembly.

Figure 11A:
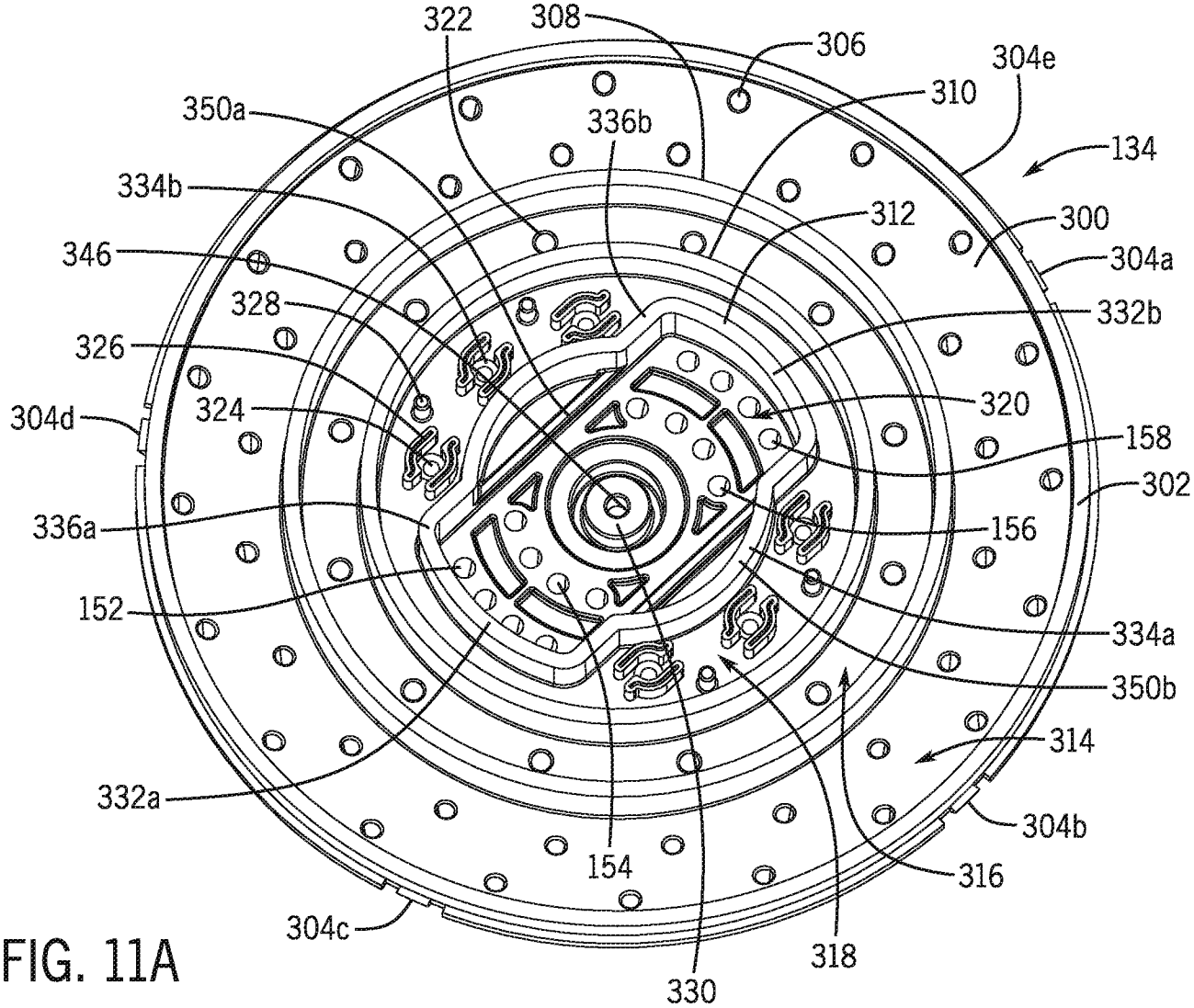
FIG. 11A is a top plan view of a face plate of the engine of FIG. 6.
Figure 11B:
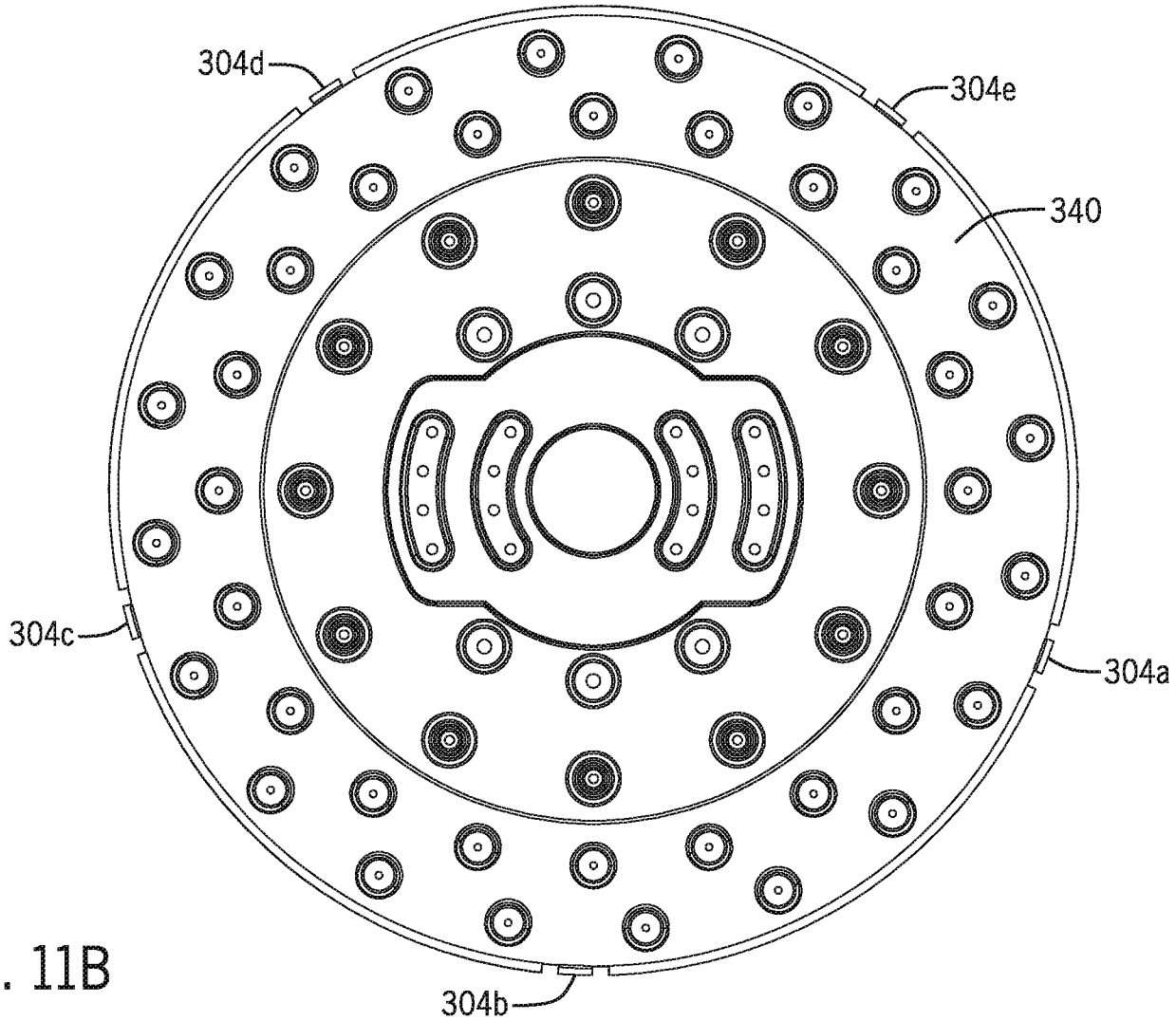
FIG. 11B is a bottom plan view of the face plate of FIG. 11A.

The face plate 134 or nozzle plate will now be discussed in more detail. FIGS. 11A and 11B illustrate top and bottom views of the face plate 134. The face plate 134 defines apertures that form the various nozzle groups for the spray head 102 of the showerhead 100. With reference to FIG. 11A, the face plate 134 includes an interior surface 300 having a plurality of mode walls that extend upwards from the interior surface to define a plurality of mode channels. A fourth mode or outer wall 302 extends around the perimeter of the interior surface 300 and forms the outer wall for the face plate 134. A third mode wall 308 is concentric to and positioned radially closer to a center of the face plate 134 from the fourth wall 302. A third mode channel 314 is defined between the third mode wall 308 and the fourth mode wall 302. A second mode wall 310 may be concentric with the third mode wall 308 and with the third mode wall 308 define a second mode channel 316. A first mode channel 318 defined by the second mode wall 310 and the massage wall 312. Each of the mode channels 314, 316, 318 include a plurality of mode apertures 306, 322, 324 that are fluidly connected to and define the different nozzle groups 104, 106, and 108.

In one embodiment, the mode apertures 324 in the first mode channel 318 may be mist apertures and include a mist structure 326 extending from the interior surface 300 that substantially surrounds each of the apertures 324. The mist structures 326 engage with a mist cap 136*a*, 136*b* to create a mist output from the face plate 134. In some embodiments, one or more posts 328 are defined in the first mode channel 318 to support a mist cap 136*a*, 136*b* over the mist structures 326, discussed in more detail below.

With reference to FIG. 11A, the massage wall 312 extends from the interior surface 300 and is positioned around a central region of the face plate 134. The massage wall 312 is configured to engage with the massage wall 270 of the jet plate 132 and may be shaped correspondingly. In particular, the massage wall 312 includes two end walls 332*a*, 332*b* that function as bumpers for the massage assembly 138 and that may have a slightly convex curve that extends outwards away from a center axis of the face plate 134. Connected to and extending from the end walls 322*a*, 322*b*, the wall 3212 includes restraining segments 336*a*, 336*b* that define and constrain the movement of the shutter. Finally, a middle section of the sidewalls 334*a*, 344*b* include a convexly curved portion that extends outwards away from the center axis of the face plate 134. In some embodiments, the convex portion of the sidewalls 334*a*, 334*b* has an increased curvature radius as compared the curvature of the end walls. In some embodiments, restraining shelves 350*a*, 350*b* extend upwards from the interior surface 300 and are positioned within the curved sections of the sidewalls 334*a*, 3344*b*. An interior edge of the restraining shelves 350*a*, 350*b* are aligned with the restraining segments 336*a*, 336*b* of the massage wall 312 and together with the restraining segments 336*a*, 366*b* define a movement track for the shutter as discussed in more detail below. The top surface of the shelves 250*a*, 250*b* acts to support select components of the massage assembly 138 as discussed in more detail below. The face plate 134 also includes a pin structure 330 including a pin aperture 346 for receiving.

Figure 11C:
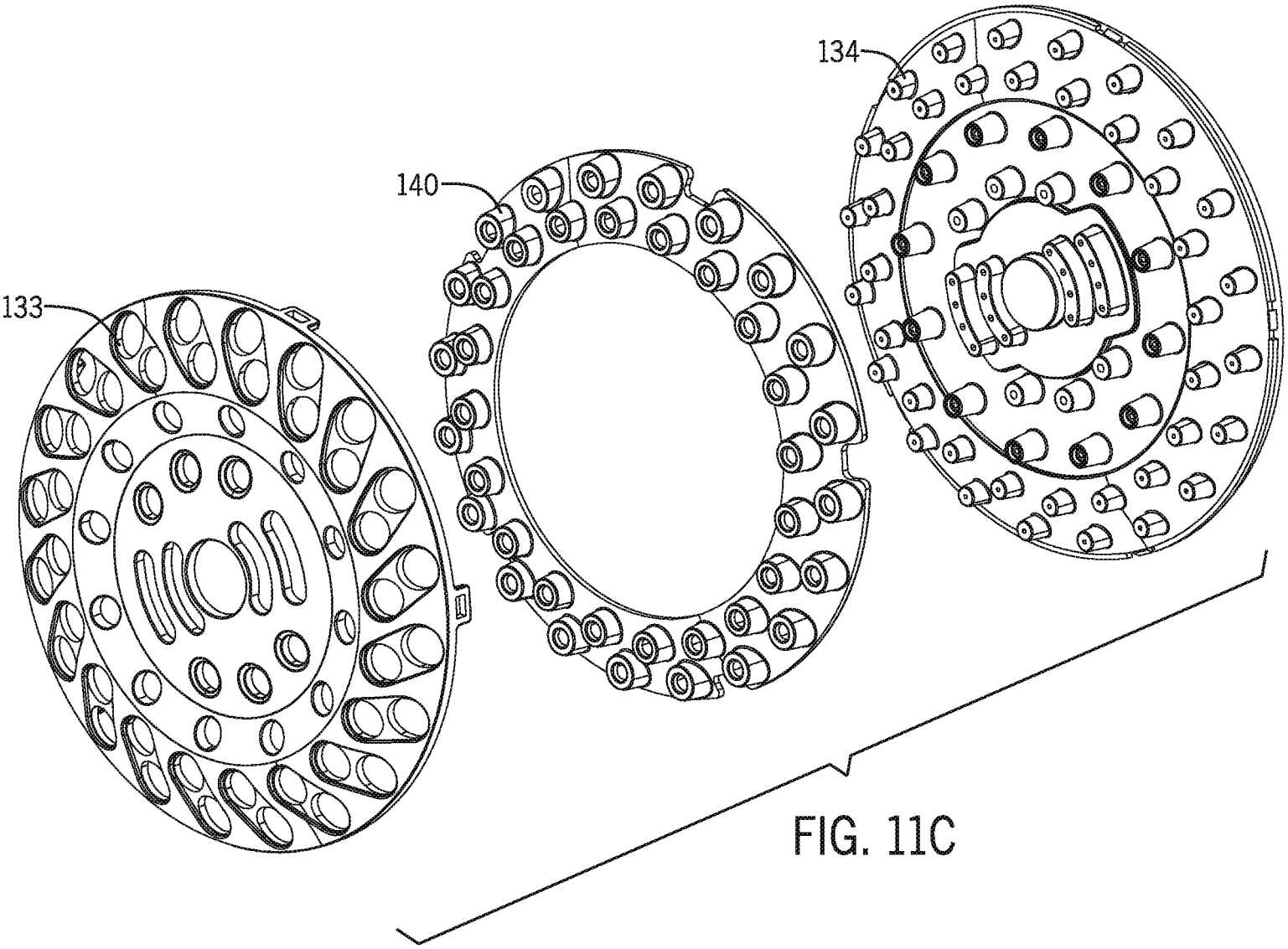
FIG. 11C is an exploded view of an example of a face plate, cover plate, and nozzle boot.

With reference to FIGS. 11A and 11B, the face plate 134 also includes retaining features 304*a*, 304*b*, 304*c*, 304*d*, 304*e* that may be spaced around an outer periphery. The retaining features 340*a*, 304*b*, 304*c*, 304*d*, 304*e* are used to a face cover to the face plate 134. In one embodiment the retaining features 304*a*, 304*b*, 304*c*, 304*d*, 304*e* are tabs that expand to insert into corresponding features on the nozzle boot 140. As shown in FIG. 11C, in some embodiments, the face plate 134 may include or be connected to a face cover 133 and the nozzle boot 140. The face cover 133 provides an aesthetically pleasing appearance for the showerhead, as well as helps to define the nozzles. In other embodiments, the face cover may be omitted or combined integrally with the face plate 134.

Figure 12A:
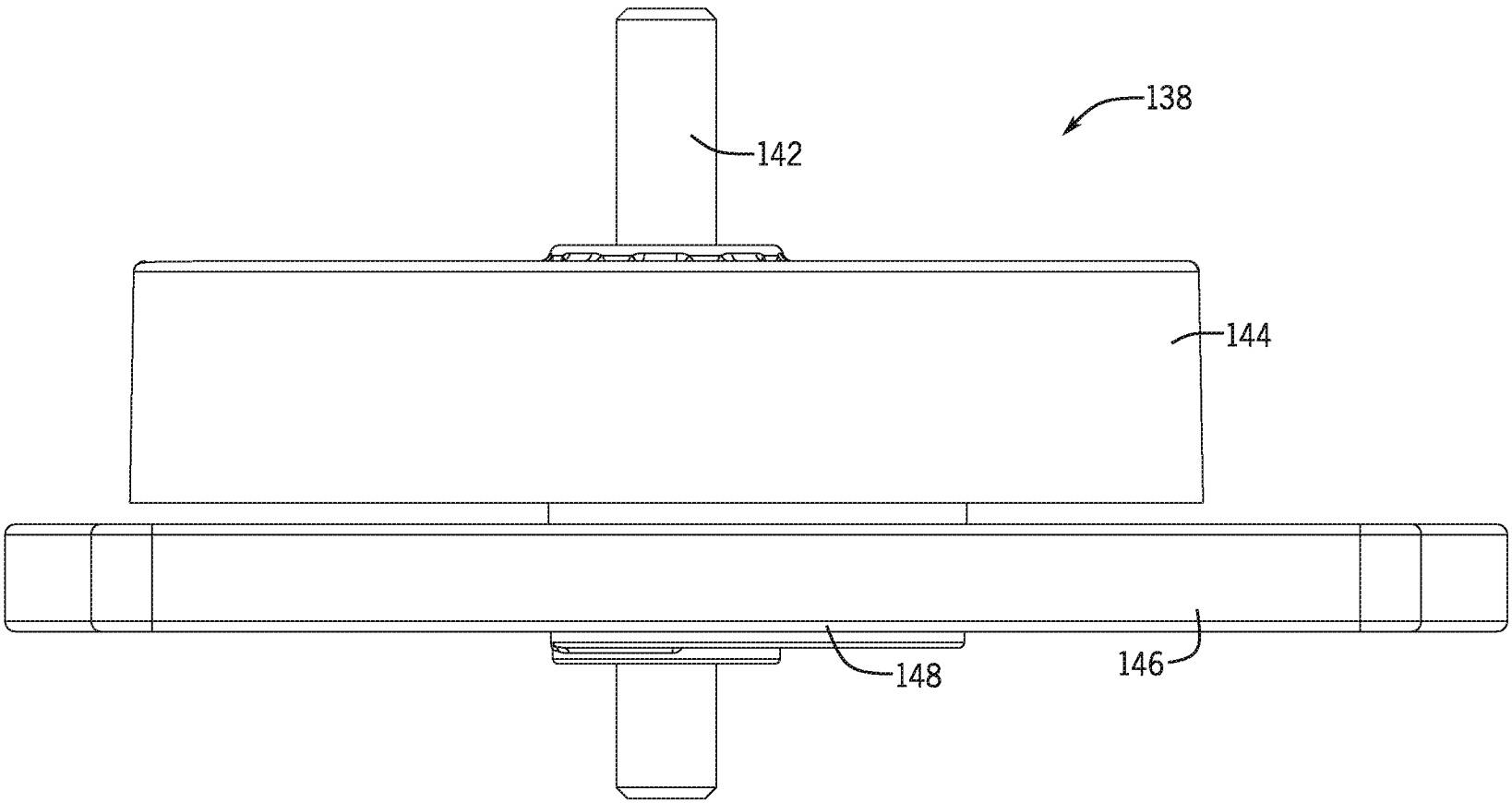
FIG. 12A is a front elevation view of the massage mode assembly.
Figure 12B:
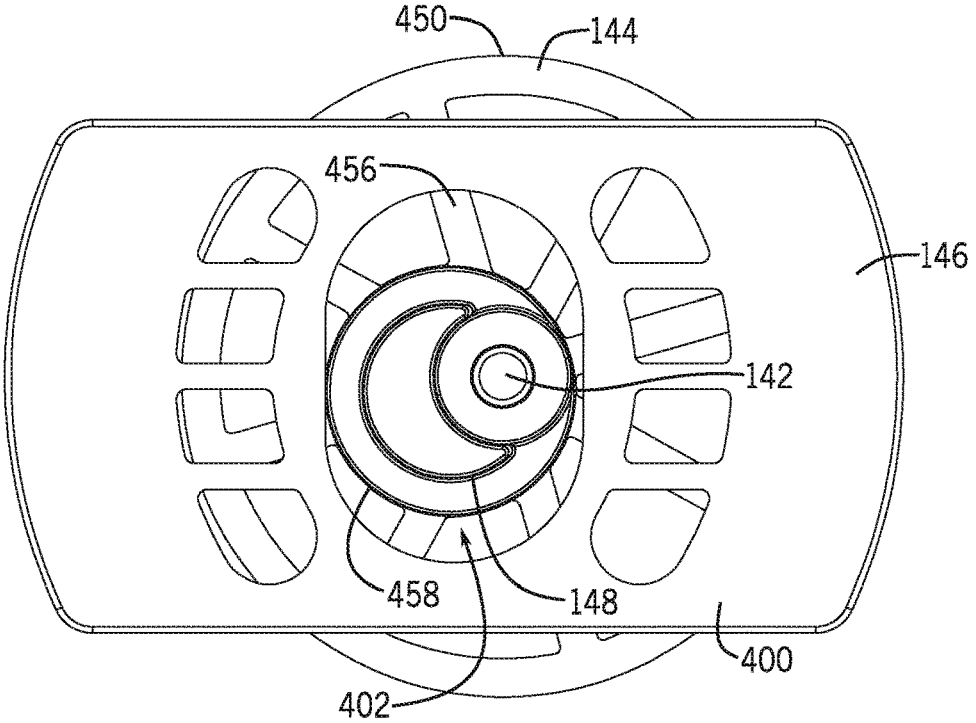
FIG. 12B is a bottom plan view of the massage mode assembly.
Figure 12C:
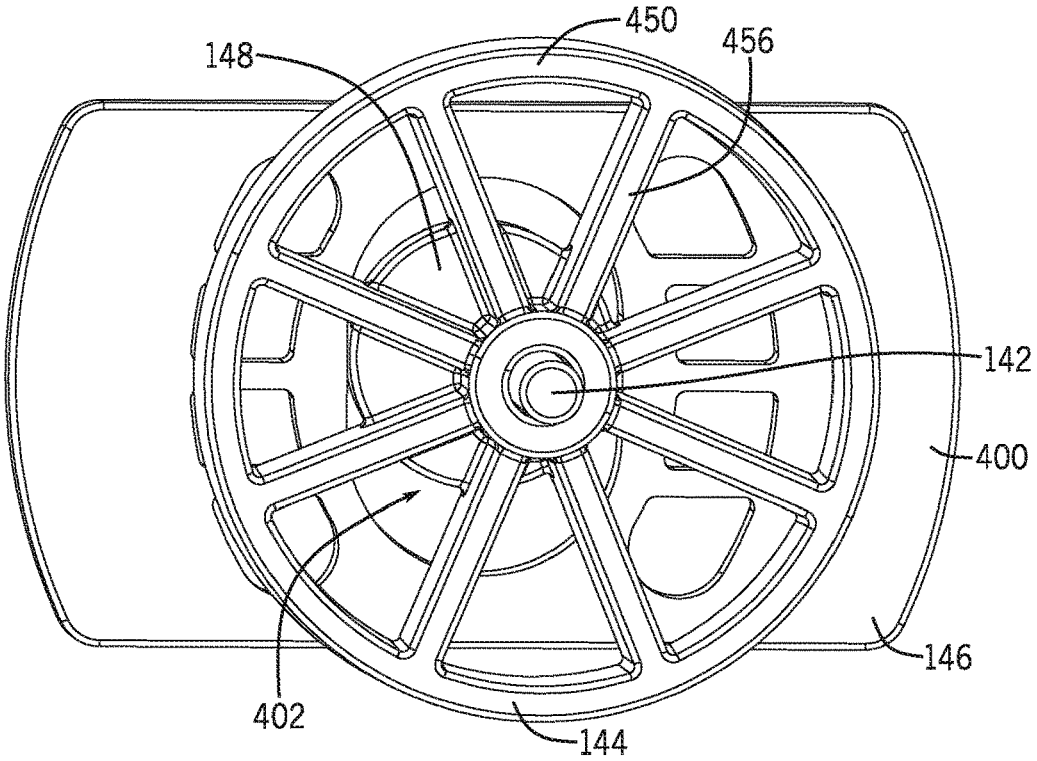
FIG. 12C is a top plan view of the massage mode assembly.

The massage assembly 138 will now be discussed in more detail. FIGS. 12A-12C illustrate various views of the massage assembly 138. The massage assembly 138 includes a securing shaft 142, a drive element 144, a cam 148, and a shutter 146 operably connected together. The shaft 142 may be a pin or other rigid member that defines a rotation axis for the drive element 144.

Figure 13:
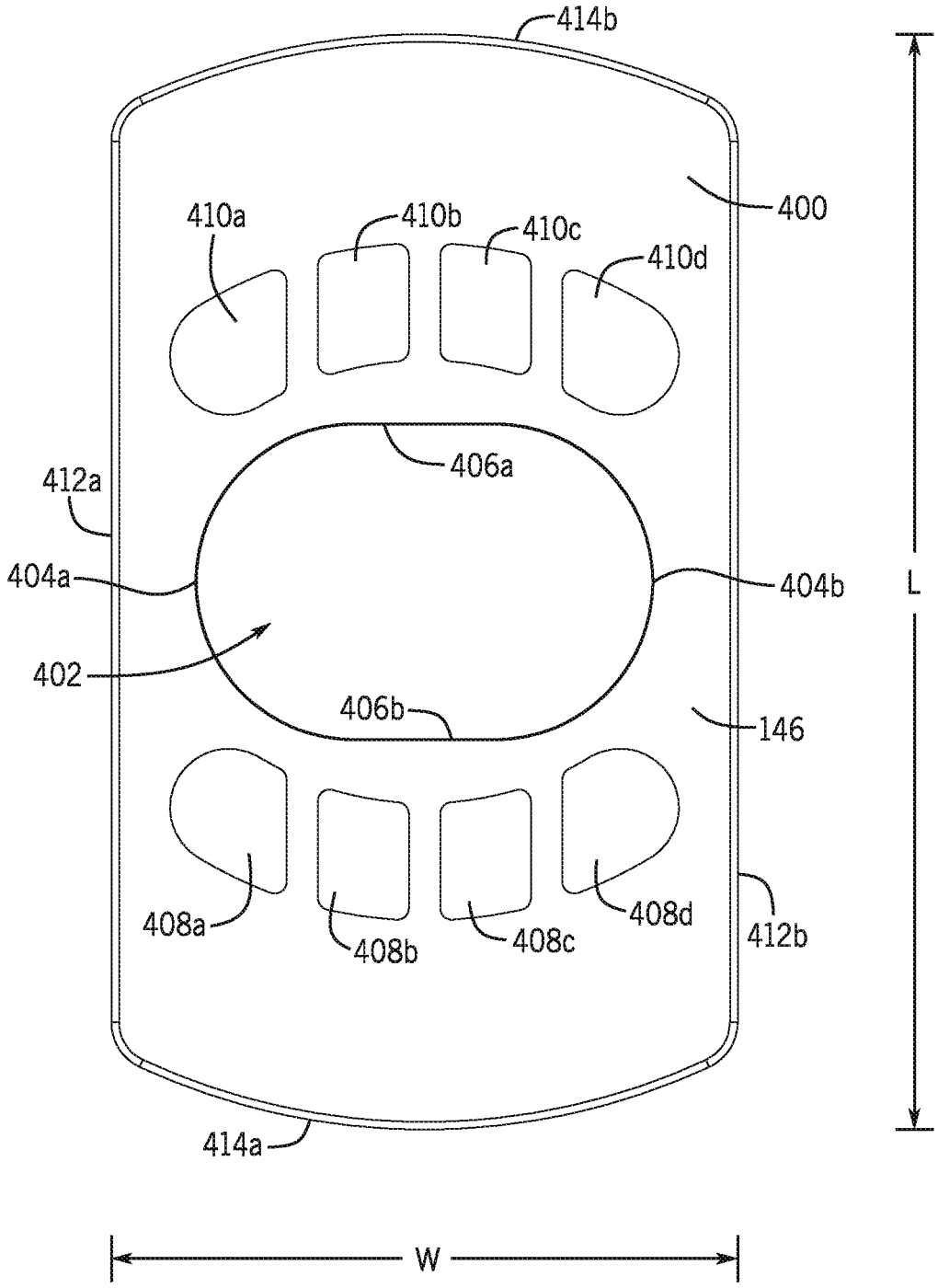
FIG. 13 is a top plan view of a shutter of the massage mode assembly.

The shutter 146 defines a blocking body driven to selectively cover and uncover groups of nozzle apertures. FIG. 13 is a top plan view of the shutter 146. With reference to FIGS. 12A and 13, the shutter 146 includes a main body 400 having a length L and a width W. The length L is selected to be larger than a maximum diameter of the drive element 144, which allows nozzle apertures on either side of the drive element 144 to be closed simultaneously.

Two side or engagement edges 412*a*, 412*b* and two end or bumper edges 414*a*, 414*b* define the longitudinal and latitudinal lengths of the shutter, respectively. In some embodiments, the engagement edges 412*a*, 412*b* are straight parallel edges and the bumper edges 414*a*, 414*b* are slightly curved edges that extend between the two engagement edges 412*a*, 412*b*. The curvature and shape of the engagement and bumper edges 412*a*, 412*b*, 414*a*, 414*b* is selected based on the configuration of the massage mode chamber and walls in the jet plate 132 and face plate 134 and may be modified as desired. The engagement and bumper edges 412*a*, 412*b*, 414*a*, 414*b* may each have a consistent thickness that defines a height of the shutter 146.

A cam aperture 402 is defined through a central region of the shutter body 400. The cam aperture 402 is shaped to engage with the drive element 144 and produce an oscillating movement. In some embodiments, the cam aperture 402 is generally oval shaped oriented across a width of the shutter body 400, e.g., the maximum radius of the oval shape extends along the width of the shutter body 400 rather than the length. In some embodiments, the top and bottom walls 404*a*, 404*b* defining the top and bottom ends, respectively, of the cam aperture 402 may be curved whereas the sidewalls 406*a*, 406*b* defining the sides of the cam aperture 402 may be somewhat straight or have a reduced curvature as compared to the top and bottom walls 404*a*, 404*b*.

The shutter 146 also includes a plurality of flow apertures 408, 410 or flow windows defined through the body 400. The flow apertures 408, 410 are spaced apart from the bumper edges 414*a*, 414*b* and arranged around the edges 406*a*, 406*b* of the cam aperture 402. In some embodiments, the a first set of flow apertures 408*a*, 408*b*, 408*c*, 408*d* are arranged along a curved path on a first side of the cam aperture 402 and a second set of flow apertures 410*a*, 410*b*, 410*c*, 410*d* are defined along a curved path adjacent the second side of the cam aperture 402. Each of the flow apertures 408*a*, 408*b*, 408*c*, 408*d*, 410*a*, 410*b*, 410*c*, 410*d* may be similarly shaped or may be different from one another. In some embodiments, flow apertures on adjacent sides of the cam aperture 402 may be formed as mirror images of the opposite side. For example, in embodiments where the flow apertures extend in a curved manner, the leading edge of the arc is selected to ensure that the outlet nozzles open simultaneously with the end of the shutter opening the outboard bank of the nozzles. In other words, the arc radius, as well as the diameter of the flow apertures, is selected such that the nozzles aligning with the flow apertures are opened at the same time as the end of the shutter uncovers a second set of nozzles as described in more detail below.

In some embodiments, the flow apertures may be defined as a singular slot or opening on either side of the cam aperture. However, in embodiments where the opening includes ribs to define discrete flow apertures, the ribs help to keep the shutter substantially flat while it is moving and help to prevent the shutter from catching on the internal features of the face plate while it is oscillating.

Figure 14A:
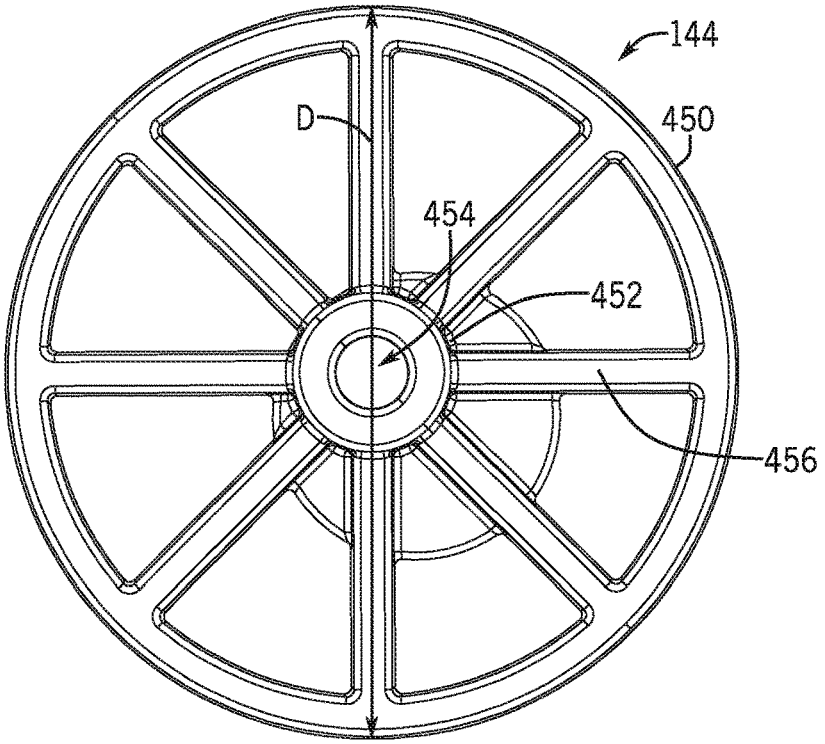
FIG. 14A is a top plan view of a drive element of the massage mode assembly.
Figure 14B:
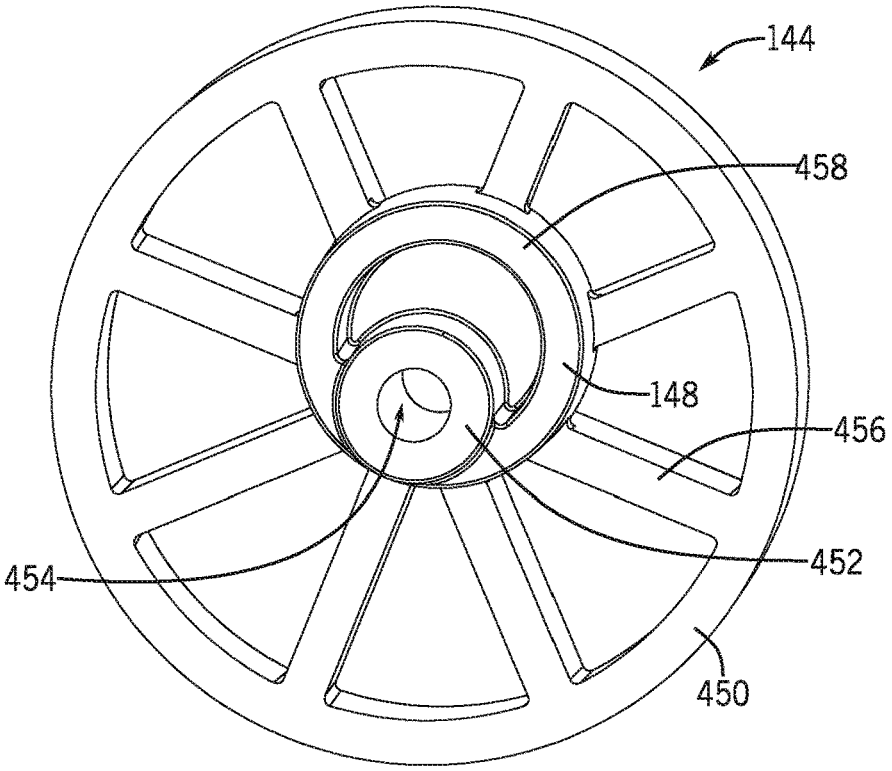
FIG. 14B is a bottom plan view of the drive element of FIG. 14A.

The drive element 144 will now be discussed in more detail. FIGS. 14A and 14B illustrate top and bottom isometric views of the drive element 144. The drive element 144 drives the shutter 146 and is powered by water from the inlet 150. The drive element 144 may be configured in a number of different manners, but in one embodiment may be formed as a turbine having a center shaft 452 with a plurality of blades 456 extending radially outward therefrom, and a rim 450 connecting the blades 456 and defining the outer surface of the drive element 144. In some embodiments, the blades 456 are defined as fins that are spatially separated from one another such that fluid can flow between the blades 456, but still impact the blades 456 to rotate the drive element 144. In some embodiments, the drive element 144 is formed as a generally circular structure including a diameter D defining the width of the drive element 144. However, in other embodiments the drive element 144 may be non-circular shaped and may have a length and width. A pin recess 454 is defined through a center of the center shaft 452 and extends through the length of the shaft 452.

With reference to FIG. 14B, a cam surface 458 is defined as a circular eccentric member extending from the center shaft 452. The cam surface 458 may be defined on the bottom of the drive element 144, positioned beneath the blades 456 and outer rim 450. The cam surface 458 terminates before the bottom edge of the center shaft 452 and has a center axis offset from a center axis of the center shaft 452. In this manner, the center axis of the cam surface 458 is offset from a center axis of the outer rim 450 and is configured to define an oscillating motion for the shutter 146, as discussed in more detail below.

Figure 15:
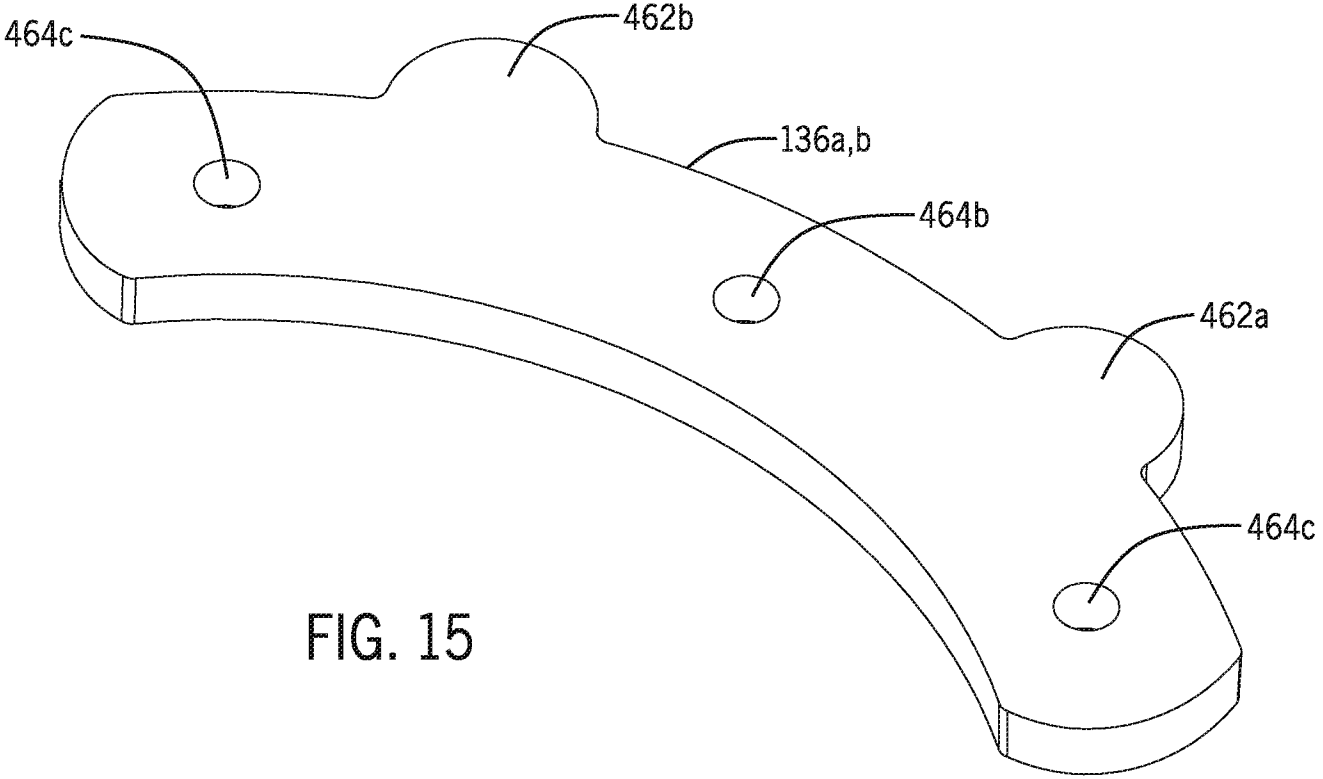
FIG. 15 is an isometric view of a mist cap for the showerhead of FIG. 1.

As briefly discussed above, in some embodiments, the showerhead 100 may include a mist feature. In these embodiments, the mist caps 136*a*, 136*b* are connected to the face plate 134. FIG. 15 illustrates one example of the mist caps 136*a*, 136*b*. The mist caps 136*a*, 136*b* may be formed as a generally curved bracket including two supporting nubs 462*a*, 462*b* that extend from one edge and a plurality of mist apertures 464*a*, 464*b*, 464*c* defined therethrough. The mist caps 136*a*, 136*b* can be configured in other manners and works with the face plate 134 to create a desired fluid pattern.

Assembly of the showerhead 100 will now be discussed in more detail. It should be noted that the below discussion is meant as exemplary only and many of the steps can be done in other orders, simultaneously, or omitted. In some embodiments, the engine 124 is first assembled and can then be connected to the housing 116 as a unit. With reference to FIG. 8, to assemble the engine 124, the jet plate 132 is aligned with and connected to the mounting plate 130. The respective mode walls are aligned with the corresponding walls on the opposite plate. For example, the fourth mode wall 242 of the jet plate 132 is aligned with and engages the fourth mode wall 200 of the mounting plate 130; the third mode wall 240 aligns with and engages the third mode wall 198 of the mounting plate 130; the second mode wall 238 of the jet plate 132 aligns with and engages the second mode wall 196 of the mounting plate; and the first mode wall 236 of the jet plate 132 aligns with an engages the first mode wall 202 of the mounting plate 130. In this manner, the discrete mode flow pathways are defined by the combination of the channels defined by the mounting plate 130 and jet plate 132 mode walls. Specifically, the massage channels 208, 234 of the two plates 130, 132 combine to define a massage entry chamber 270, a first mode chamber 480 is defined by the two first mode channels 202, 244, a second mode chamber 482 defined by the second mode channels 204, 246, and a third mode chamber 484 is defined by the third mode channels 206, 248.

Each of the mode chambers 470, 480, 482, 484 are in fluid communication with a respective mode aperture 176*a*, 176*b*, 176*c*, 176*d* in the mounting plate 130 and the first mode chamber 480 is in fluid communication with the trickle mode aperture 210 as well as the first mode aperture 176*b*. However, in other embodiments, other mode chambers may be configured to be in fluid communication with the first mode aperture 176*b*.

With reference to FIGS. 9 and 12A-12C, the massage assembly 138 is then assembled and connected to the jet plate 132 and the face plate 134. In particular, securing shaft 142 is received within the pin recess 454 of the drive element 144 and the shutter 146 is connected to the cam 148. Specifically, the cam 148 is received in the cam aperture 420 of the shutter 146 with the cam surface 458 engaging the sidewalls 406*a*, 406*b*. As shown in FIG. 12C, once assembled, the shutter 146 length L extends past the outer perimeter of the rim 450 on both sides of the drive element 144. This is due to the length L of the shutter 146 being longer than the diameter of the outer rim 450.

With reference to FIGS. 8 and 11A, the massage assembly 138 is connected to the face plate 134. The securing shaft 142 is positioned within the pin aperture 346 defined in the pin structure 330 of the face plate 134. The shutter 146 is positioned within the massage chamber 320 and the engagement edges 412*a*, 412*b* of the shutter 146 are positioned adjacent to and engage with the restraining shelves 350*a*, 350*b* and restraining segments 336*a*, 336*b* of the massage wall 312. The bumper edges 414*a*, 414*b* are positioned adjacent to the end walls 332*a*, 332*b* of the massage wall 312. Depending on the position of the shutter 146, one of the bumper edges 414*a*, 414*b* will engage with one of the end walls 332*a*, 332*b* (as will be discussed below, as the shutter 146 changes position, the other of the bumper edges 414*a*, 414*b* will engage with the other of the end walls 332*a*, 332*b*).

The face plate 134 and massage assembly 138 will then be connected to the bottom of the jet plate 132. With reference to FIGS. 8, 11A, and 10B, the top end of the securing shaft 142 is received within the pin recess 276 defined on the jet plate 132. The massage wall 270 of the jet plate 132 is aligned with and engages the corresponding massage wall 312 of the face plate 132. The end walls 332*a*, 332*b* of the face plate 134 engage with the corresponding end walls 272*a*, 272*b* of the jet plate 132 with the middle sections of the sidewalls 334*a*, 334*b*, 274*a*, 274*b* being aligned as well to define a massage chamber 472 therebetween with the massage assembly 138 being received within the chamber 472.

The various mode walls are then aligned between the two plates 132, 134 as described above with respect to the connection between the mounting plate 130 and the jet plate 132 to define the different mode chambers. However, in addition to the first through the fourth walls being connected together, the outer wall 264 of the jet plate 132 is connected to and engages the outer wall 302 of the face plate 134. The combination of the jet plate 132 and the face plate 134 defines a first mode chamber 486 in fluid communicating with the first mode chamber 480 through the first mode apertures 256 of the jet plate 132, a second mode chamber 488 in fluid communication with the second mode chamber 482 through the second mode apertures 254 of the jet plate 132; and a third mode chamber 490 in fluid communication with the third mode chamber 484 through the apertures 252 of the jet plate 132. The massage chamber 472 is fluid communication with the massage entry chamber 470 through the jets 260*a*, 260*b*, 260*c* and the massage disruptor jets 262.

The various plates 130, 132, 134 of the engine 124 are secured together in a variety of manners, such as ultrasonic welding, adhesive, press fit, or the like. Once connected, the nozzle boot 140 is connected to the outer surface of the face plate 134 and is positioned over the various nozzles defined by the face plate 134.

With reference to FIGS. 4 and 5, after the engine 124 is connected together, the mode selector assembly 500 is connected to the back cover 160. The mode selector assembly 500 seals around the perimeter of one or more mode apertures of the mounting plate 130 to direct fluid into a specific mode aperture (or multiple mode apertures) and may include a seal 506 and a spring 504. The mode selector assembly 500 is received within a compartment in the back cover 160. Additionally, the showerhead 100 may include a feedback assembly 502 that includes a biasing element 508 and a detent 510. The detent 510 is configured to be positioned in one of the detent recesses 174*a*, 174*b*, 174*c*, 174*d*, 174*d*, 174*e*, 174*g* on the mounting plate 130 to hold the showerhead in a particular mode, as well as to provide a sound and/or haptic feel to the user as the user rotates the mode selector 112 to select different modes.

Once the mode selector assembly 500 and the feedback assembly 502 are connected to the back cover 160, the back cover 160 is positioned within the housing 116. The mode selector 112 is then connected to the back cover 160 and configured to rotate the back cover 160, moving the mode selector assembly 500 and the feedback assembly 502, to different locations relative to the mounting plate 130 as discussed in more detail below. The engine 124 is connected to the back wall of the housing 116 by the engine connection assembly 126, which in turn secures the back cover 160 within the housing 116. The engine connection assembly 126 may include a fastener that is received within the fastening aperture 184 defined in the shaft 182 of the mounting plate 130 of the engine 124 and secures the engine 124 to the housing 116. As discussed in U.S. application Ser. No. 14/304,495 entitled "Showerhead with Turbine Driven Shutter," filed Jun. 13, 2014 and incorporated by reference herein in its entirety, the engine connection assembly 126 allows the engine 124 to be easily and quickly replaced.

With reference to FIG. 4, the flow regulator 118 and filter 121 are connected to the connector 114 and received whiten the bottom end of the handle 103. The showerhead 100 is then fluidly coupled to a fluid source, such as a hose, tube, or J-pipe.

Operation of the Showerhead

With reference to FIG. 3, when water is delivered to the handle 103, the water flows into the flow regular 118 and filter 120 and flows into the handle passageway 120. From the handle passageway 120, the water is directed into the inlet lumen 188 of the mounting plate 130 and flows around the shaft 182 and out of the plate outlet 190. As the water exits out of the plate outlet 190, the water is directed into a cavity defined in the back cover 160 that includes the mode selector assembly 500. The water flows through the seal 506 into one or more of the mode apertures 176*a*, 176*b*, 176*c*, 176*d* of the mounting plate 130. The mode selected depends on the orientation of the mode selector assembly 500 relative to the top surface 170 of the mounting plate 130 and can be varied by rotating the mode selector 112, which in turn rotates the back cover 160 and the mode selector assembly 500 which is connected thereto, correspondingly.

The feedback assembly 502 engages the top surface 170 of the mounting plate 130 and the detent 510 is inserted into one of the detent recesses 174*a*-174*g* corresponding to a particular mode, with the biasing element 508 biasing the detent 510 towards the mounting plate 130.

With reference to FIGS. 4, 5, and 8, when the first mode is selected, the first mode aperture 176*a* is fluidly connected to the plate outlet 190 and water flows therethrough. The water then flows into the first mode chamber 480 and through the first mode flow apertures 256 in the jet plate 132 into the first mode chamber 486 between the jet plate 132 and the face plate 134 and around the mist cap 460 into the first mode apertures 324. With reference to FIG. 3, the first mode apertures 324 define the first nozzle group 104 on the spray face 102 and the water is dispelled from those nozzles 104. In embodiments where the first mode corresponds to a mist mode, the water is dispelled in fine droplets, but in other embodiments may be dispelled in other manners.

When the trickle mode is selected, the mode selector assembly 500 is aligned with the trickle mode aperture 210 defined in the mounting plate 130. The fluid then follows the same path as described with respect to the first mode, but due to the decreased diameter of the trickle mode aperture 210 with respect to the first mode aperture 176*a*, the flow volume is significantly reduced, if not completely eliminated.

With reference again to FIGS. 4, 5, and 8, when the second mode is selected, the mode selector assembly 500 is aligned with the second mode apertures 176*b* in the mounting plate 130. The water then flows through the second mode aperture 176*b* into the second mode chamber 482 defined between the mounting plate 130 and the jet plate 132. The water enters the second mode chamber 488 defined between the jet plate 132 and the face plate 134 through the second mode apertures 254 in the jet plate 132. From the second mode chamber 488, the water exits the spray head 102 through the second mode apertures 322 in the face plate 134, which define the second nozzle group 106.

When the third mode is selected, the mode selector assembly 500 is aligned with the third mode apertures 176*c* and the water is directed into the third mode chamber 484 defined between the mounting plate 130 and the jet plate 132. From the third mode chamber 484, the water flows through the third mode apertures 252 in the jet plate 132 into the third mode chamber 490 defined between the jet plate 132 and the face plate 134. From the third mode chamber 490, the water exits the spray head 102 out of the third mode apertures 306 that define the third mode nozzle group 108.

When the massage mode is selected, the mode selector 500 is aligned with the mode aperture 176*d*. The water flows through the massage mode aperture 176*d* in the mounting plate 130 into the massage entry chamber 470. The water is directed to the jets 260*a*, 260*b*, 260*c* with a small amount of water flowing directly through the disruptor jets 262. The disruptor jets 262 reduce the fluid impacting the turbine, to reduce the speed of the turbine and create a desired massage pulse. By siphoning fluid through these jets 262, the output massage pulse may be slower and distinct. However, in instances where a faster pulse is desired, the jets 262 can be omitted. In some embodiments, the turbine rotates at approximately 1200 rotations per minute (rpm), which is considerably slower than conventional massage mode turbines. The slower rotational speed provides a more distinct massage pulse as the pulses are longer than in conventional showerheads.

The diameter of the disruptor jets 262 is selected to reduce the rotational speed of the turbine. In some embodiments, the diameter may be based primarily on an inlet to outlet ratio. Specifically, the jet diameters should be sized large enough to allow sufficient flow, but small enough to create a desired impingement force. In short, a balance between allow the flow to be sufficiently high to allow a desired flow pattern without flooding the massage chamber and without causing the turbine to stall during rotation.

From the jets 260, 260*b*, 260*c*, the water flows through the jet plate 132 and is angled towards the blades 456 of the drive element 144. This causes the drive element 144 to rotate about the securing shaft 142, causing the cam 148 to rotate, causing the cam surface 458 to move the shutter 146 between first and second positions. The cam surface 458 rotates within the cam aperture 402 and interfaces against the walls 404*a*, 404*b*, 406*a*, 406*b* defining the cam aperture 402 and due to the oblong shape of the cam aperture 402, causes the shutter 146 to oscillate side to side.

Figure 16A:
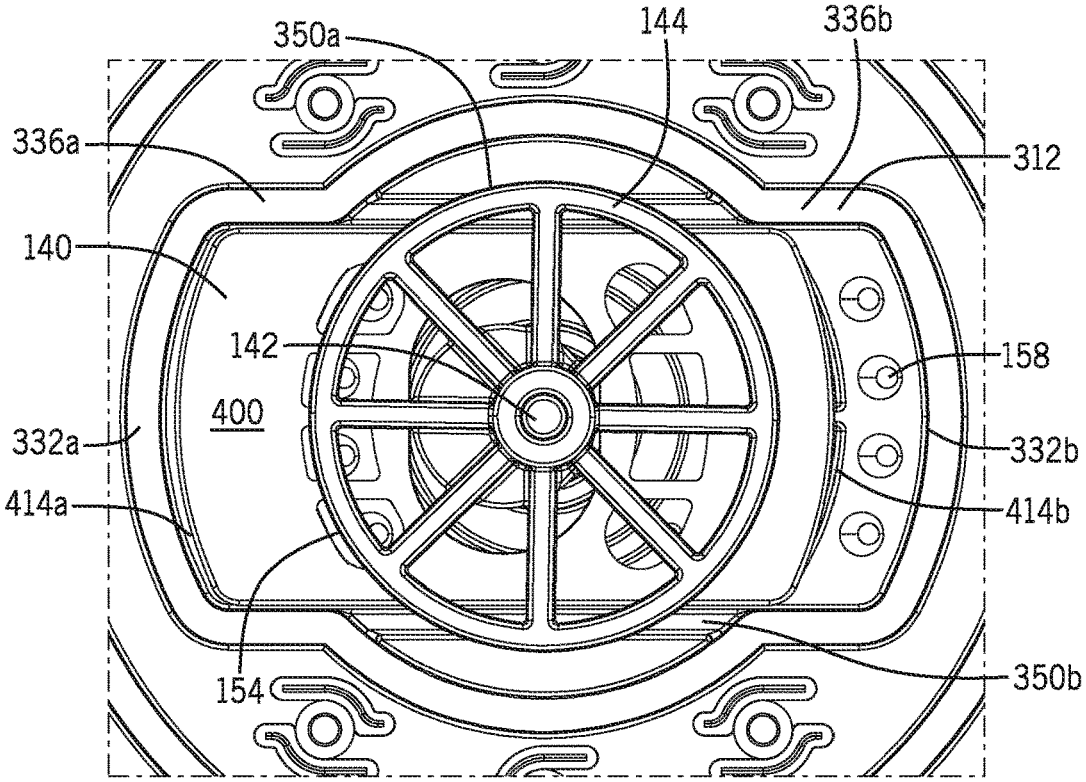
FIG. 16A is an enlarged cross-section view of the engine illustrating the shutter in a first position.
Figure 16B:
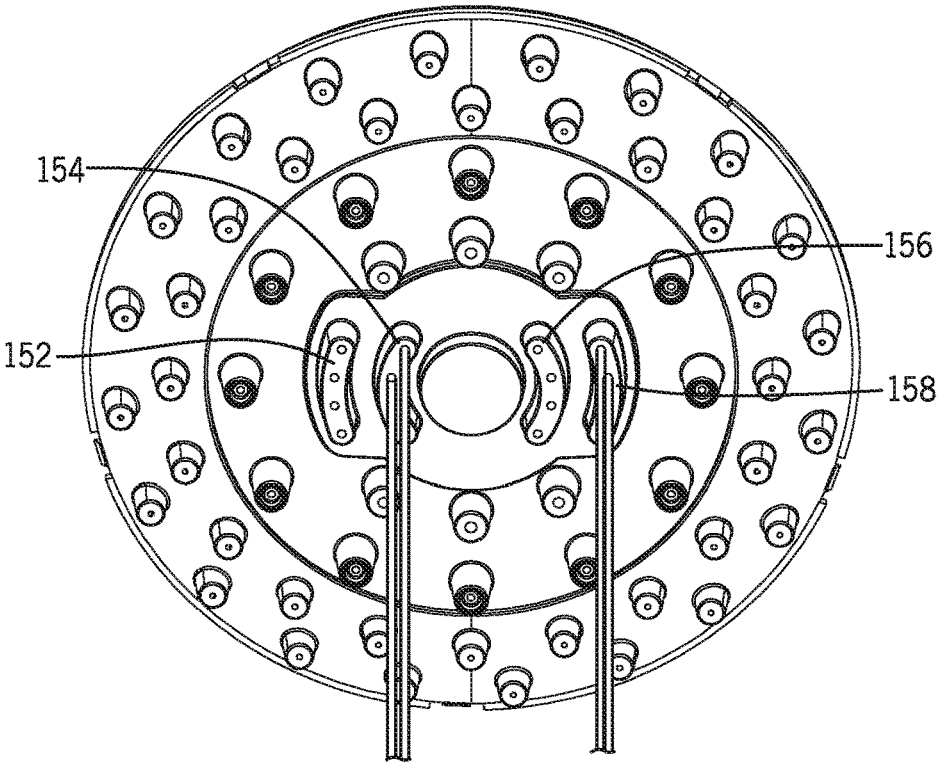
FIG. 16B is an isometric view of the face plate illustrating the water pattern with the shutter in the first position of FIG. 16A.

FIGS. 16A and 16B illustrate the showerhead in the massage mode with the shutter 146 in the first position. With reference to FIG. 16A, in the first position, the bumper edge 414*a* of the shutter 146 abuts against and may engage the bumper end wall 332*a*. In this position, the body 400 of the shutter 146 covers the first nozzle bank 152 and the first set of flow apertures 408*a*, 408*b*, 408*c*, 408*d* are positioned over the second nozzle bank 154, fluidly connecting the second nozzle bank 154 with the massage chamber 472, causing fluid to be expelled from the nozzles in the second nozzle bank 154. Simultaneously, the second end of 414*b* of the shutter 146 is spaced apart from the second end wall 332*b* of the massage wall 312 defined by the face plate 134. The gap uncovers the fourth nozzle bank 158, fluidly connecting the nozzles in the fourth nozzle bank 158 with the massage chamber 472. The third nozzle bank 156, however, is covered by the body 400 of the shutter 146 and is not in fluid communication with the massage chamber 472. In other words, the shutter 146 defines two flow paths between the inlet and the face plate of the showerhead, one that extends around an outer or terminal edge of the shutter and one that extends through the shutter (e.g., through the flow apertures).

With reference to FIG. 16B, in the first position, the second and fourth nozzle banks 154, 158 are open at the same time and the first and third nozzle banks 152, 156 are closed at the same time. This allows the water to be expelled in pulses from either side of the central region 161 and drive element 144 of the showerhead 100 at the same time.

Figure 17A:
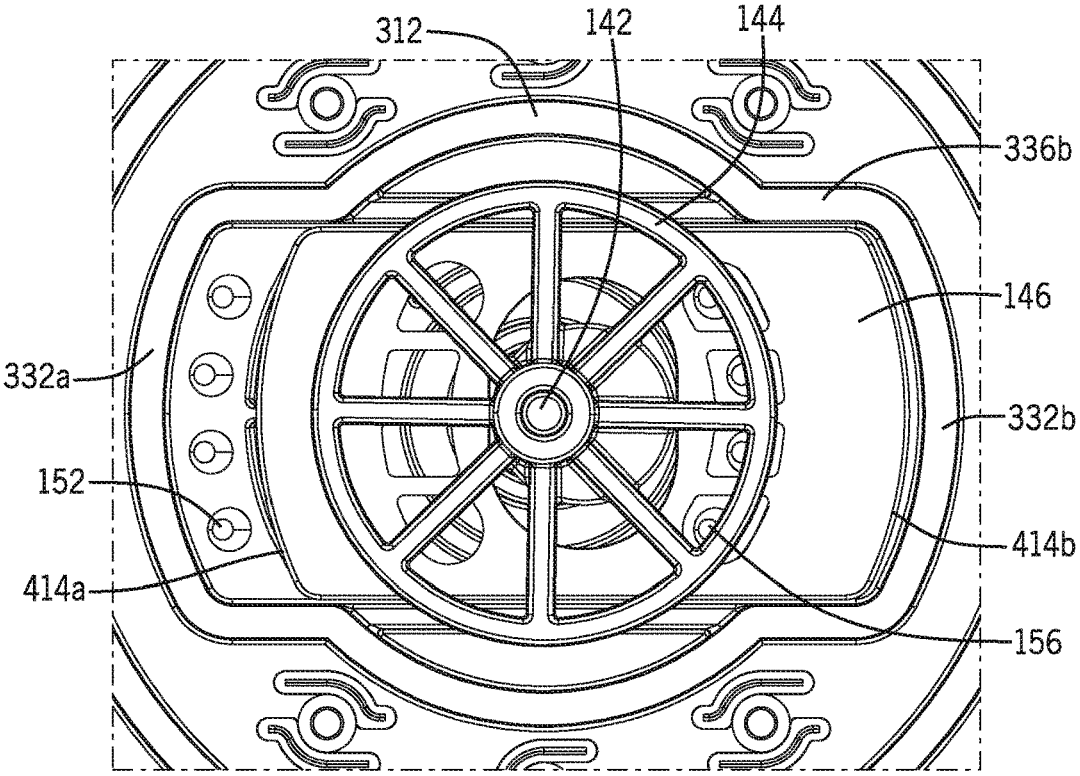
FIG. 17A is an enlarged cross-section view of the engine illustrating the shutter in a second position.
Figure 17B:
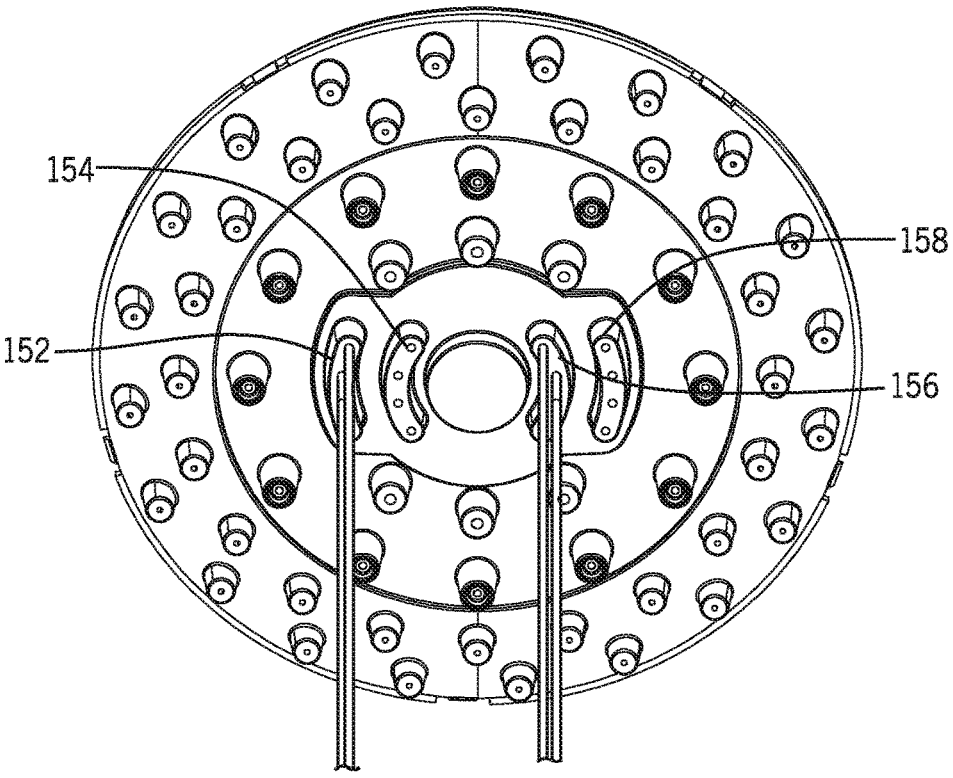
FIG. 17B is an isometric view of the face plate illustrating the water pattern with the shutter in the second position of FIG. 17A.

As the drive element 144 continues to rotate due to the water emitted from the jets 260*a*, 260*b*, 260*c*, the cam 148 rotates in the R direction (see FIG. 16A), moving the shutter 146 from the first position in FIG. 16A to the second position shown in FIG. 17A. In particular, the cam 148 causes the shutter 146 to move along the track 270 with the restraining walls 336*a*, 336*c* constraining the movement of the shutter 146 such that the shutter 146 moves in a substantially linear motion within the track, despite the rotational movement of the drive element. In the second position, the body of the shutter 146 blocks the second and fourth nozzle banks 154, 158 and fluidly connects the first and third nozzle banks 152, 156 to the massage chamber 472. Thus fluid is expelled from the first and third nozzle banks 152, 156. Similarly to the first position, in this second position of the shutter, two flow paths are defined between the inlet and the face plate, one around the edge of the shutter and one through the shutter.

In some embodiments, the water flow through each nozzle aperture in a particular nozzle bank starts and stops substantially simultaneously. This creates a more forceful effect as compared to conventional massage modes. Also, due to the shutter configuration, nozzles on either side of a central axis of the drive element are actuated simultaneously, delivering the massage pulse to different sections of a user's body simultaneously.

Figure 19:
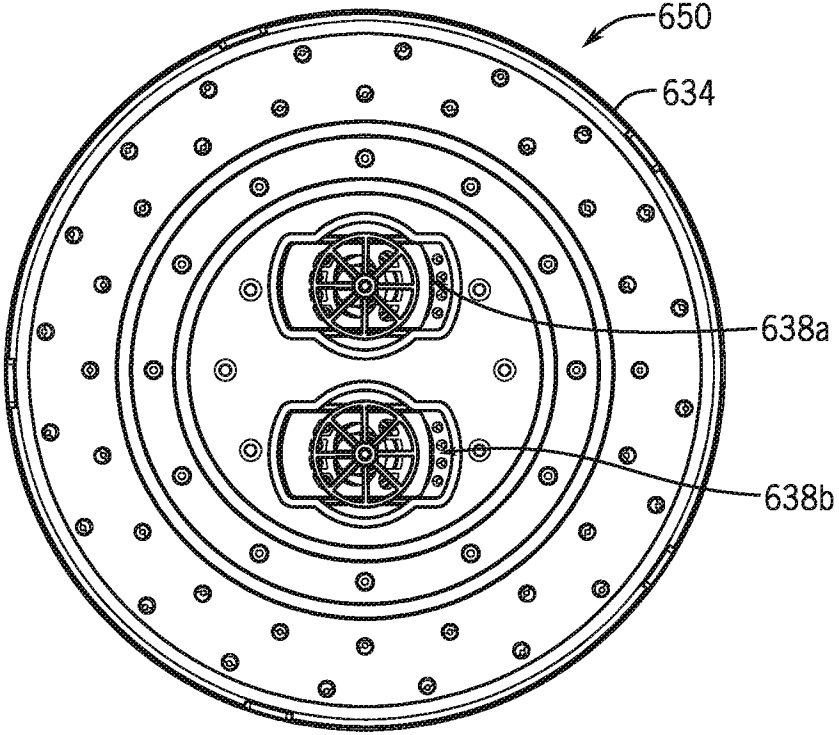
FIG. 19 illustrates another embodiment of the showerhead.

FIG. 19 illustrates another embodiment of the showerhead. With reference to FIG. 19, in this embodiment, a showerhead 650 may include a faceplate 634 supporting two massage assemblies 638*a*, 638*b*. In this embodiment, each of the massage assemblies 638*a*, 638*b* may be substantially similar to one another, but in other embodiments may have different features, such as different nozzle outlet configurations, different spin ratios, or the like. The dual massage assemblies 638*a*, 638*b* may be driven by a single turbine or multiple turbines and may be positioned in any one of the different spray pattern locations on the faceplate 634. In operation, when flow enters into the massage mode faceplate area, both massage assemblies 638*a*, 638*b* are activated, generating a dual force massage stream for a user.

It is noted that although FIG. 19 illustrates the two massage mode assemblies 638*a*, 638*b* positioned parallel to one another, in other embodiments, the massage mode assemblies 638*a*, 638*b* may be positioned perpendicular to one another or at other orientations as desired. Similarly, the shutters 146 for each of the massage mode assemblies 638*a*, 638*b* may be synchronized to match or counter the movement of the opposite shutter in order to generate a desired spray pattern. For example, the shutters movements may be paired, sequential, offset, or the like.

Conclusion

It should be noted that although the various examples discussed herein have been discussed with respect to showerheads, the devices and techniques may be applied in a variety of applications, such as, but not limited to, sink faucets, kitchen and bath accessories, lavages for debridement of wounds, pressure washers that rely on pulsation for cleaning, car washes, lawn sprinklers, and/or toys.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the invention, and do not create limitations, particularly as to the position, orientation, or use of the invention unless specifically set forth in the claims. Joinder references (e.g., attached, coupled, connected, joined and the like) are to be construed broadly and may include intermediate members between the connection of elements and relative movement between elements. As such, joinder references do not necessarily infer that two elements are directly connected and in fixed relation to each other.

In some instances, components are described by reference to "ends" having a particular characteristic and/or being connected with another part. However, those skilled in the art will recognize that the present invention is not limited to components which terminate immediately beyond their point of connection with other parts. Thus the term "end" should be broadly interpreted, in a manner that includes areas adjacent rearward, forward of or otherwise near the terminus of a particular element, link, component, part, member or the like. In methodologies directly or indirectly set forth herein, various steps and operations are described in one possible order of operation but those skilled in the art will recognize the steps and operation may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A showerhead comprising:

a massage mode assembly for a showerhead comprising:

a drive element having a drive element length, wherein the drive element is rotatable by fluid around an axis;

a cam connected to the drive element and rotatable therewith; and a shutter operably connected to the cam, wherein the shutter has a shutter length that is longer than the drive element length and rotation of the cam causes the shutter to move correspondingly;

wherein the shutter comprises:

a cam aperture defined through a central region thereof, wherein the cam is received into the cam aperture; and a plurality of flow apertures spaced about the cam aperture;

wherein the plurality of flow apertures comprise:

a first group of flow apertures positioned on a first side of the cam aperture; and a second group of flow apertures positioned on a second side of the cam aperture;

a faceplate in fluid communication with the massage mode assembly;

wherein the shutter is movable between a first position in which a first edge flow path is defined around a first end of the shutter and a first aperture flow path is defined through the first group of flow apertures, and a second position in which a second edge flow path is defined around a second end of the shutter and a second aperture flow path is defined through the second group of flow apertures; and wherein the faceplate includes a first group of outlet nozzles, a second group of outlet nozzles, a third group of outlet nozzles, and a fourth group of outlet nozzles each in selective fluid communication with one of the first edge flow path, the first aperture flow path, the second edge flow path, or the second aperture flow path.

2. The showerhead of claim 1, wherein the plurality of flow apertures are distributed in an arc around the cam aperture.

3. The showerhead of claim 1, wherein each aperture of the plurality of flow apertures has a non-circular shape.

4. The showerhead of claim 1, further comprising a track, wherein the shutter is at least partially received within the track and the track constrains movement of the shutter in one direction.

5. The showerhead of claim 1, wherein the drive element comprises a turbine.

6. The showerhead of claim 5, wherein the drive element length comprises an outer diameter of the turbine.

7. The showerhead of claim 6, wherein the first group of flow apertures and the second group of flow apertures are positioned substantially within the outer diameter of the turbine during operation of the massage mode assembly.

8. The showerhead of claim 7, wherein the shutter includes opposing ends that are located outwardly of the outer diameter of the turbine during operation of the massage mode assembly.

9. The showerhead of claim 8, wherein the opposing ends of the shutter are curved.

10. The showerhead of claim 8, wherein:

the first group of flow apertures is positioned between one of the opposing ends of the shutter and the cam aperture; and the second group of flow apertures is positioned between the other of the opposing ends of the shutter and the cam aperture.

11. The showerhead of claim 1, wherein:

the first group of outlet nozzles is in selective fluid communication with the first edge flow path;

the second group of outlet nozzles is in selective fluid communication with the second edge flow path;

the faceplate includes mode apertures associated with a different spray mode than the first group of outlet nozzles and the second group of outlet nozzles; and the first group of outlet nozzles, the second group of outlet nozzles, and the mode apertures are positioned at the same diameter from a center of the faceplate.

12. The showerhead of claim 11, wherein:

the third group of outlet nozzles is in selective fluid communication with the first aperture flow path;

the fourth group of outlet nozzles is in selective fluid communication with the second aperture flow path; and the third group of outlet nozzles and the fourth group of outlet nozzles are positioned closer to the center of the faceplate than the first group of outlet nozzles, the second group of outlet nozzles, and the mode apertures.

13. The showerhead of claim 11, wherein the mode apertures comprise mist mode apertures.

14. The showerhead of claim 1, wherein:

the faceplate includes a massage wall defining a massage chamber in which the massage mode assembly is positioned;

the faceplate includes a mode wall positioned outward of and surrounding the massage wall;

a mode channel is defined between the mode wall and the massage wall; and the faceplate includes mode apertures in fluid communication with the mode channel.

15. A showerhead comprising:

a massage mode assembly comprising:

a drive element having a drive element length, wherein the drive element is rotatable by fluid around an axis;

a cam connected to the drive element and rotatable therewith; and a shutter operably connected to the cam, wherein the shutter has a shutter length that is longer than the drive element length and rotation of the cam causes the shutter to move correspondingly, wherein the shutter comprises a cam aperture defined through a central region thereof, the cam is received into the cam aperture, and a plurality of flow apertures is spaced about the cam aperture, wherein the plurality of flow apertures comprises a first group of flow apertures positioned on a first side of the cam aperture and a second group of flow apertures positioned on a second side of the cam aperture; and a faceplate in fluid communication with the massage mode assembly;

wherein:

the shutter is movable between a first position in which a first edge flow path is defined around a first end of the shutter and a first aperture flow path is defined through the first group of flow apertures, and a second position in which a second edge flow path is defined around a second end of the shutter and a second aperture flow path is defined through the second group of flow apertures;

the faceplate includes a first group of outlet nozzles in selective fluid communication with the first edge flow path and a second group of outlet nozzles in selective fluid communication with the second edge flow path;

the faceplate includes mode apertures associated with a different spray mode than the first group of outlet nozzles and the second group of outlet nozzles; and the first group of outlet nozzles, the second group of outlet nozzles, and the mode apertures are positioned at the same diameter from a center of the faceplate.

16. The showerhead of claim 15, wherein:

the faceplate includes a third group of outlet nozzles in selective fluid communication with the first aperture flow path and a fourth group of outlet nozzles in selective fluid communication with the second aperture flow path; and the third group of outlet nozzles and the fourth group of outlet nozzles are positioned closer to the center of the faceplate than the first group of outlet nozzles, the second group of outlet nozzles, and the mode apertures.

17. The showerhead of claim 15, wherein the mode apertures comprise mist mode apertures.

* * * * *